US007984985B2

(12) United States Patent
Yokoyama

(10) Patent No.: US 7,984,985 B2
(45) Date of Patent: Jul. 26, 2011

(54) IMAGE FORMING APPARATUS

(75) Inventor: Noriko Yokoyama, Tokyo (JP)

(73) Assignees: Olympus Corporation, Tokyo (JP); Ortek Corporation, Tokyo (JP)

( * ) Notice: Subject to any disclaimer, the term of this patent is extended or adjusted under 35 U.S.C. 154(b) by 1029 days.

(21) Appl. No.: 11/880,627

(22) Filed: Jul. 23, 2007

(65) Prior Publication Data

US 2008/0024582 A1 Jan. 31, 2008

(30) Foreign Application Priority Data

Jul. 31, 2006 (JP) ..... 2006-209047

(51) Int. Cl.
*B41J 2/01* (2006.01)

(52) U.S. Cl. ..... 347/104; 347/108

(58) Field of Classification Search ..... 347/101, 347/104, 108

See application file for complete search history.

(56) References Cited

U.S. PATENT DOCUMENTS 4,620,807 A * 11/1986 Polit ..... 400/56
5,017,969 A * 5/1991 Mitomi et al. ..... 399/299
5,246,224 A 9/1993 Matsuno et al.
5,943,081 A * 8/1999 Uchida et al. ..... 347/104
6,139,140 A * 10/2000 Rasmussen et al. ..... 347/104
6,309,064 B1 * 10/2001 Tanno et al. ..... 347/104
7,152,971 B2 * 12/2006 Kumagai et al. ..... 347/104
7,497,567 B2 3/2009 Kumagai
2005/0140723 A1 * 6/2005 Taira ..... 347/40
2006/0170751 A1 * 8/2006 Yokoyama et al. ..... 347/104

FOREIGN PATENT DOCUMENTS

JP 2731963 B2 12/1997
JP 2004-161477 A 6/2004
JP 2005-138371 A 6/2005
JP 2005-170547 A 6/2005
JP 2006-137027 A 6/2006

OTHER PUBLICATIONS

Japanese Office Action dated May 17, 2011 in counterpart Japanese Application No. 2006-209047.

* cited by examiner

*Primary Examiner* — Daniel Petkovsek

(74) *Attorney, Agent, or Firm* — Holtz, Holtz, Goodman & Chick, PC

(57) ABSTRACT

An apparatus includes: a recording unit for holding an ink head capable of jetting liquid ink to a recording medium; a feeding mechanism arranged opposite the recording unit and feeding the recording medium having at least a feed belt, a driving roller and a driven roller for providing the feed belt, a support frame for holding the driving roller and the driven roller; and a feed roller feeding the recording medium by correcting feeding posture of the recording medium to the feeding mechanism. The support axis of the feed roller is held by a support frame of the feeding mechanism.

13 Claims, 22 Drawing Sheets

IMAGE FORMING APPARATUS

CROSS REFERENCE TO RELATED APPLICATIONS

This according to claims benefit of Japanese Application No. 2006-209047, filed Jul. 31, 2006, the contents of which are incorporated by this reference.

BACKGROUND OF THE INVENTION

1. Field of the Invention

The present invention relates to an image forming apparatus for recording an image on a recording medium.

2. Description of the Related Art

Conventionally, an image forming apparatus is well known for forming a color image on a recording medium by jetting liquid ink of each color, for example, black (K), cyan (C), magenta (M), and yellow (Y) onto the recording medium from an ink head group including a plurality of ink heads mounted in an image forming apparatus.

In the image forming apparatus, a belt platen is provided as a feeding mechanism for feeding the recording medium. Provided above the belt platen is a recording unit for holding ink heads for jetting the liquid ink of the respective colors of black (K), cyan (C), magenta (M), and yellow (Y). The ink heads are fixed at predetermined intervals in the feeding direction of the recording medium for each color.

The belt platen has, for example, an endless belt, and the belt is put on between a driving roller and a driven roller. A tension roller maintains tension from inside the belt. The belt platen is configured to cyclically move the belt in a predetermined transfer direction by the driving rotation of the driving roller and the driven rotation of the driven roller and the tension roller.

The belt platen is feeds a recording medium below the ink head group with the transfer of the belt while adsorbing and holding the recording medium onto the belt when the recording medium is carried in. The ink head group jets the ink onto the recording medium fed downward, and forms an image. The recording medium on which the image is formed is fed by the belt platen, and ejected outside the apparatus.

As an image forming apparatus described above, for example, a common base unit is provided for the body of the apparatus in addition to the belt platen and the recording unit, and a positioning operation is performed by arranging the belt platen and the recording unit such that they come in contact with the base unit (for example, Japanese Published Patent Application No. 2004-161477).

Another conventional technique is, for example, an image forming apparatus for forming a toner image using a recording unit designed in an electronic photographic system on a recording medium in paper sheet form and fed by a belt platen.

In the above-mentioned image forming apparatus, a feed roller (hereinafter referred to as a "resist roller pair") is provided for regulating and amending the tilt (deviation in a feed path etc.) of the feeding direction of a recording medium at the feeding position of the recording medium of the belt platen (at the upstream in the feeding direction of the recording medium).

The resist roller pair suppresses the feed of the recording medium supplied from a paper feed device by temporarily stopping it for synchronization with the image forming timing of the recording unit, and introduces the recording medium to the belt platen by resuming the rotation in synchronization with the image forming timing.

After the feeding posture of the recording medium is corrected using the resist roller pair, the recording medium is fed to the belt platen, and adsorbed onto the belt by the adsorbent property of the belt platen.

Furthermore, the toner image is transferred to the recording medium fed by the belt platen. The recording medium to which the toner image is transferred is carried from the belt platen to a fixing device. In the fixing device, the toner image is fixed on the recording medium, and the recording medium is carried by a feed roller pair and ejected outside the apparatus (for example, refer to the Japanese Patent Publication No. 2731963).

The Japanese Patent Publication No. 2731963 discloses the recording unit having only one photosensitive material. However, as in the case of the Japanese Published Patent Application No. 2004-161477, there is an electronic photographic image forming apparatus of tandem type in which four photosensitive materials of black (K), cyan (C), magenta (M), and yellow (Y) are arranged in multi-stage form at predetermined intervals in the feeding direction. They have almost the same configuration except the number of photosensitive materials, that is, one photosensitive material or four photosensitive materials.

SUMMARY OF THE INVENTION

The image forming apparatus according to the present invention has a recording unit for holding an ink head capable of jetting liquid ink onto a recording medium, a feeding mechanism which is located opposite the recording unit and feeds the recording medium, and a feed roller for correcting the feeding posture of the recording medium and feeding the recording medium to the feeding mechanism, and the feed roller is held by the feeding mechanism.

BRIEF DESCRIPTION OF THE DRAWINGS

The present invention will be more apparent from the following detailed description when the accompanying drawings are referenced.

DESCRIPTION OF THE PREFERRED EMBODIMENTS

The modes for embodying the present invention are described below by referring to the attached drawings.

First Mode for Embodying the Present Invention

FIGS. 1 through 10 show the outline of the configuration of the image forming apparatus according to the first mode for embodying the present invention.

The entire configuration is described below by assuming that the feeding direction of a recording medium is an X-axis direction (secondary scanning direction), the direction orthogonal to the feeding direction is a width direction of the recording medium or a Y-axis direction (primary scanning direction), and the direction orthogonal to the XY plane is a Z direction (up-and-down direction).

Figure 1:
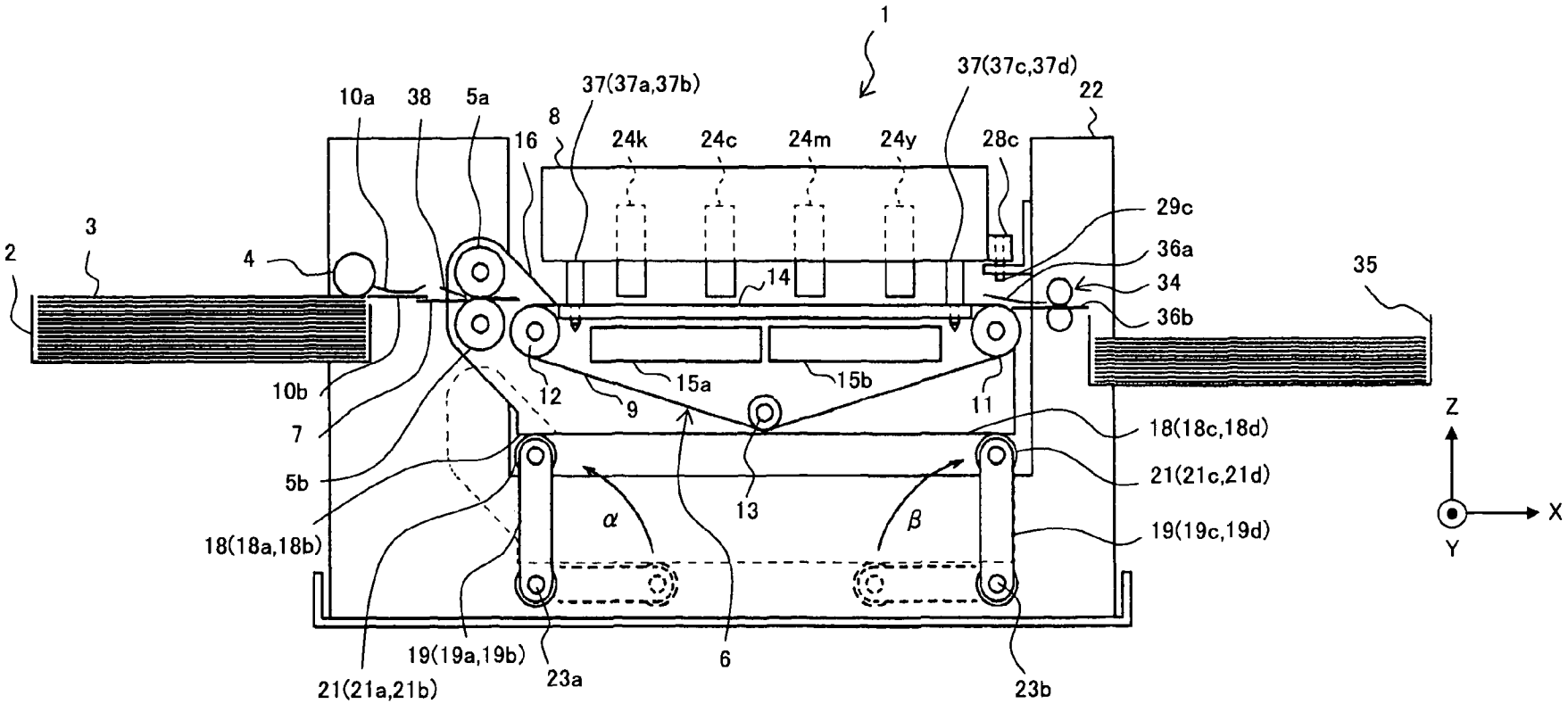
FIG. 1 is a sectional side view of an image forming apparatus according to the first mode for embodying the present invention.

As shown in FIG. 1, a paper feed tray 2 is attached as a detachable paper feed unit to one side (left side in FIG. 1) of an image forming apparatus 1. The paper feed tray 2 is loaded with sheets of paper (hereinafter referred to simply as "paper") 3 as plural sheets of recording medium.

The paper feed tray 2 is provided with a pickup roller 4 at the end portion of a sheet of fed paper (right end portion in FIG. 1). The pickup roller 4 has the function of feeding the paper 3 stored in the paper feed tray 2 to the inside of the body of the apparatus sheet by sheet At the feed path extension of the paper 3 fed from the pickup roller 4 to inside the body of the apparatus, a resist roller pair 5 (5*a*, 5*b*) is arranged as a feed roller. The resist roller pair 5 is arranged such that the upper surface of the lower resist roller 5*b* can be at substantially the same level as the feed path extension of the paper 3. Above the resist roller 5*b*, the resist roller 5*a* urged by a spring not shown in the attached drawings is arranged such that the resist roller 5*b* can be pressed. The resist roller 5*a* and the resist roller 5*b* are provided with their support axes substantially parallel to each other.

The feed path between the pickup roller 4 and the resist roller pair 5 is provided with a supply guide pair 10 for leading the paper 3 fed from the pickup roller 4 to the resist roller pair 5. The supply guide pair 10 has an upper supply guide 10*a* and a lower supply guide 10*b*. The supply guides 10*a* and 10*b* are located opposite each other at an interval appropriate for feed of the paper 3.

Provided in the downstream of the supply guide pair 10 in the feed path is a feed guide 7 for feed of the paper 3 toward a belt platen 6 as a feeding mechanism. The feed guide 7 has an aperture unit at the position corresponding to the holding unit (nip position) of the resist roller pair 5 so that the upper resist roller 5*a* and the lower resist roller 5*b* can be pressed to each other.

With respect to the resist roller pair 5, a resist guide 38 for leading the paper 3 stably to the resist roller pair 5 is provided in the upstream of the feed path and above the feed guide 7. The resist guide 38 is provided such that the paper 3 can be fed with appropriate space between the resist guide 38 and the feed guide 7.

The resist guide 38 is tilted against the feed guide 7 so that the space between the feed guide 7 and the resist guide 38 can be narrowed toward the nip position to allow the paper 3 to stably rush to the nip position of the resist roller pair 5, and the resist guide 38 is extended to the vicinity of the nip position of the resist roller pair 5. Thus, the paper 3 can be stably fed from the pickup roller 4 to the resist roller pair 5. By the resist roller pair 5, an undesired posture such as deviation in the feed path etc. of the paper 3 can be forcibly amended to a correct posture, and fed to the belt platen 6. In the mode for embodying the present invention, the feed path from the pickup roller 4 to the resist roller pair 5 is configured by the supply guide pair 10, the feed guide 7, and the resist guide 38, but the present invention is not limited to this configuration to correctly feed the paper 3 from the pickup roller 4 to the resist roller pair 5.

Figure 2:
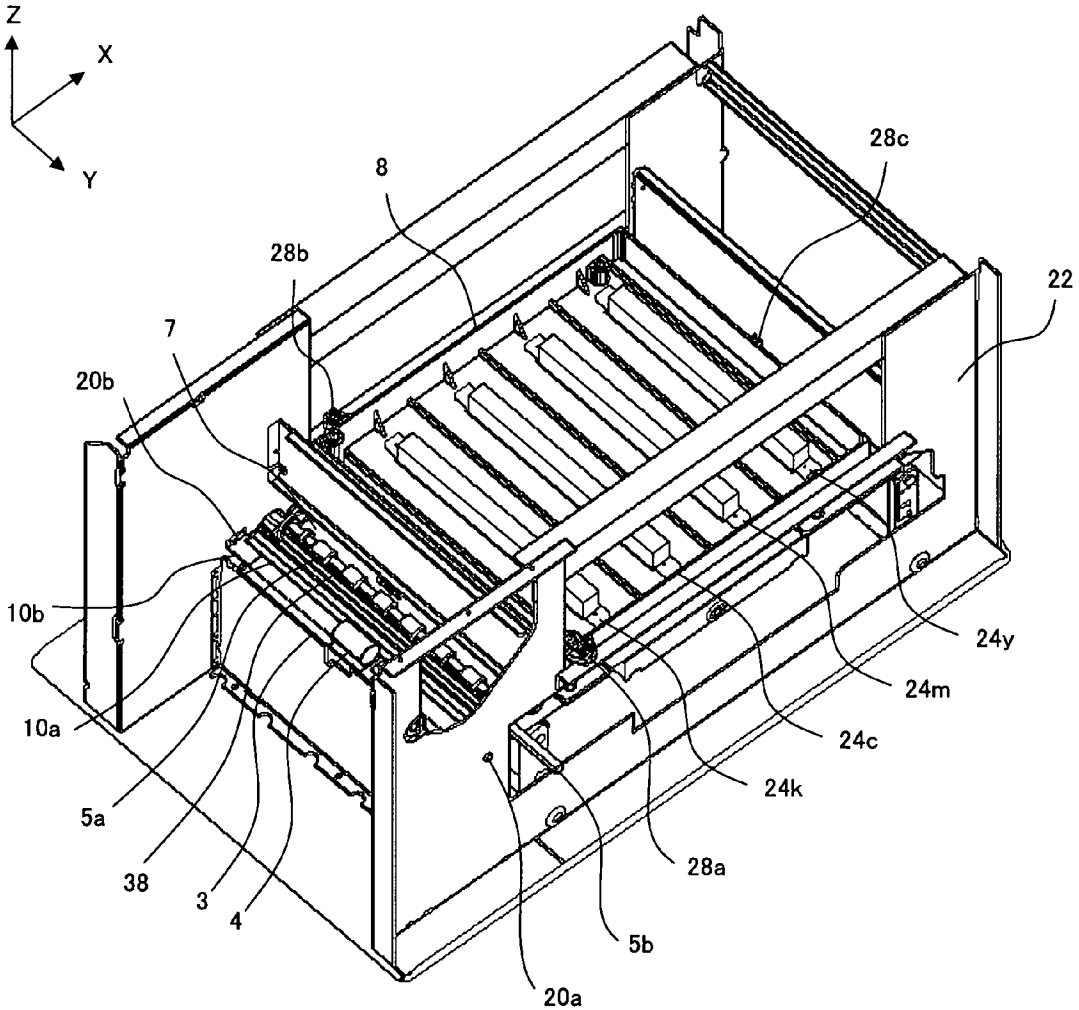
FIG. 2 is an oblique view of the image forming apparatus as shown in FIG. 1.
Figure 3:
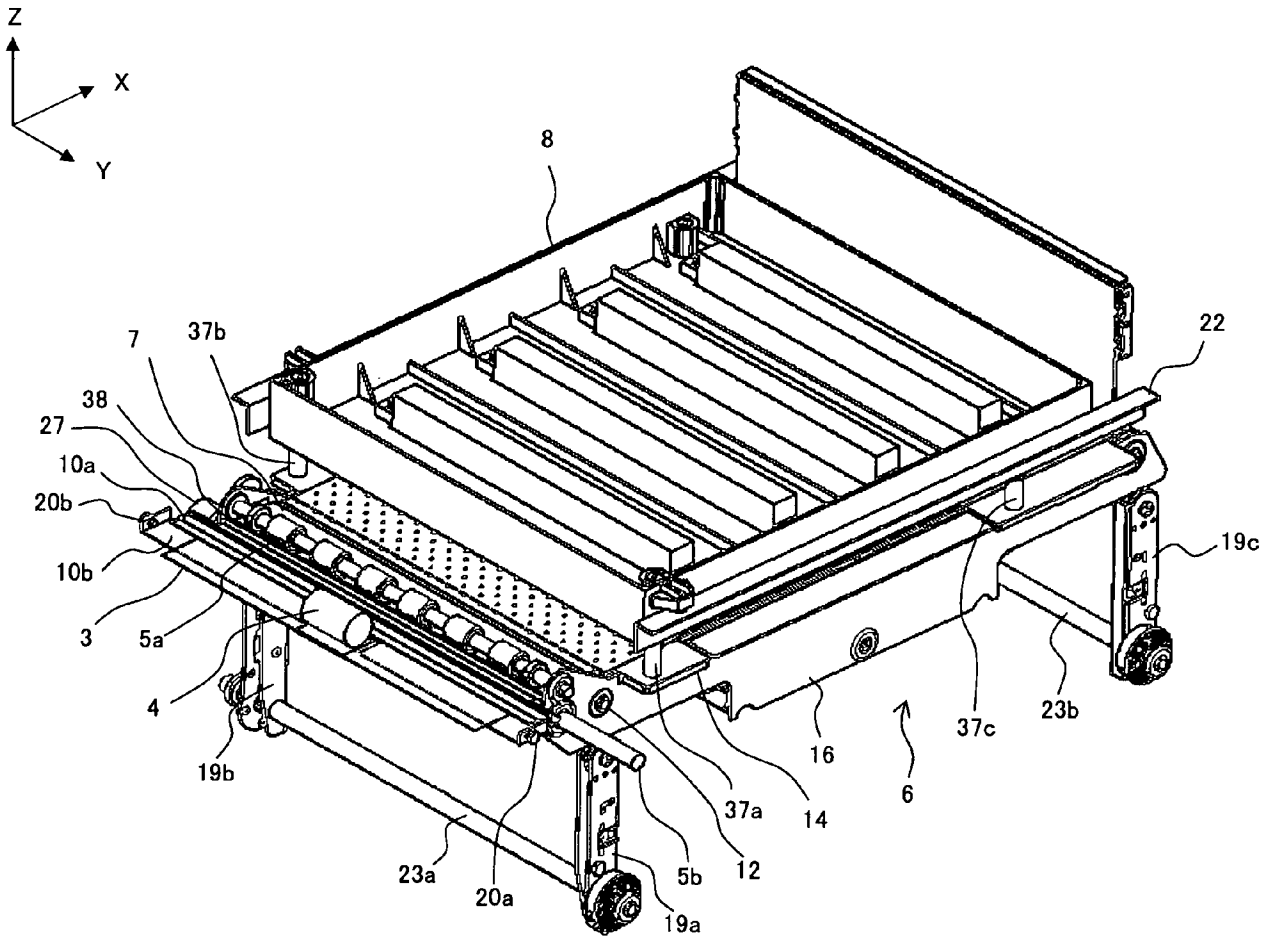
FIG. 3 is an oblique view of positioned head unit and belt platen as shown in FIG. 2 (showing the positions of a feeding unit and a recording unit)

As shown in FIGS. 2 and 3, the supply guide pair 10 is held and can swing through guide pins 20 (20*a*, 20*b*) provided at the sides of the lower supply guide 10*b*. The upper supply guide 10*a* is fixed to the lower supply guide 10*b*.

The supply guide pair 10 is held and can swing on the apparatus body frame 22 by the guide pins 20 (20*a*, 20*b*), but does not swing at an angle in excess of predetermined degrees (by a stopper not shown in the attached drawings). The supply guide pair 10 is urged to the feed guide 7 by an urging device.

Figure 4:
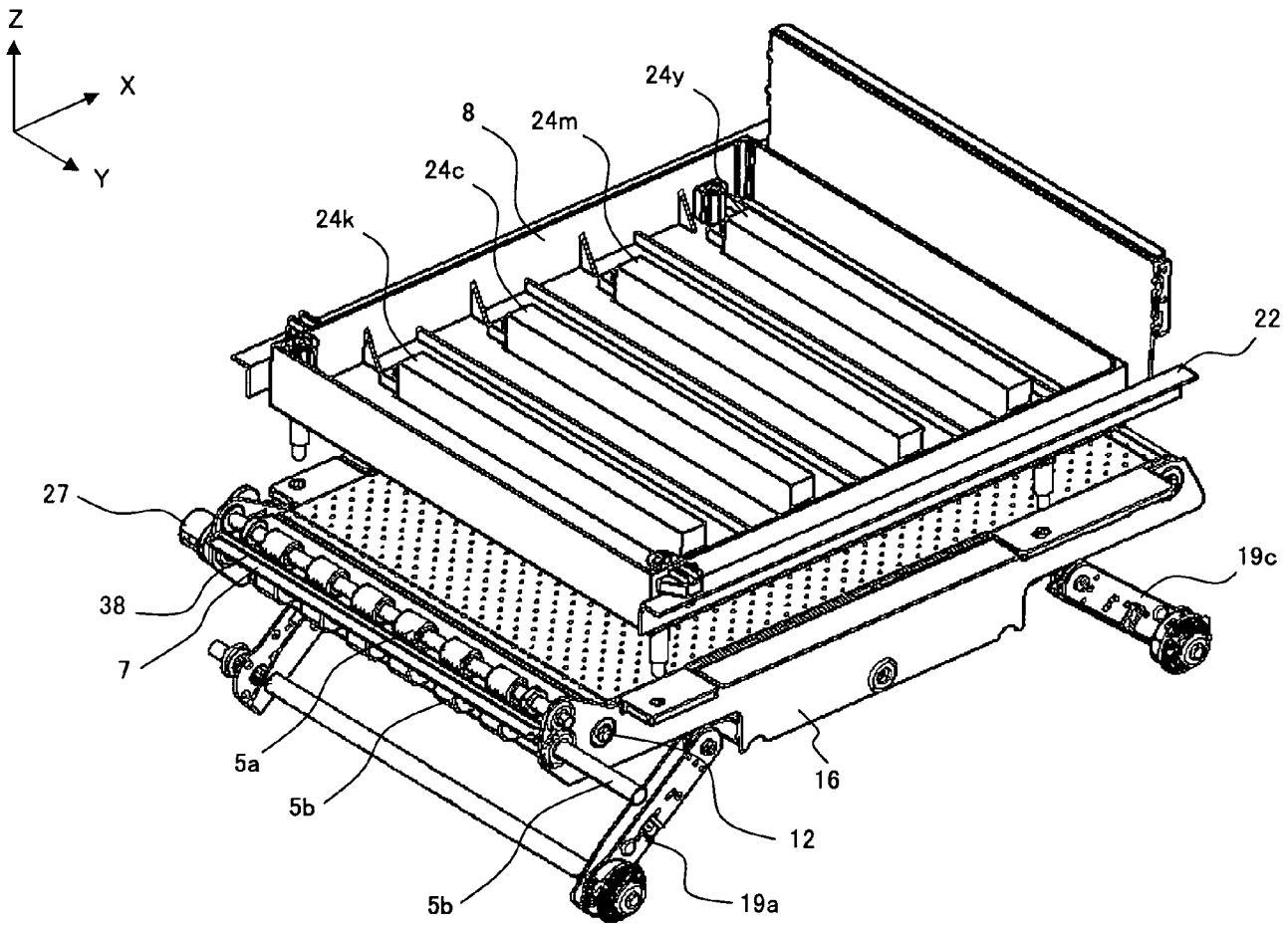
FIG. 4 is an oblique view in which the belt platen is saved from the head unit shown in FIG. 3 (showing the saved position of the feeding unit)
Figure 5:
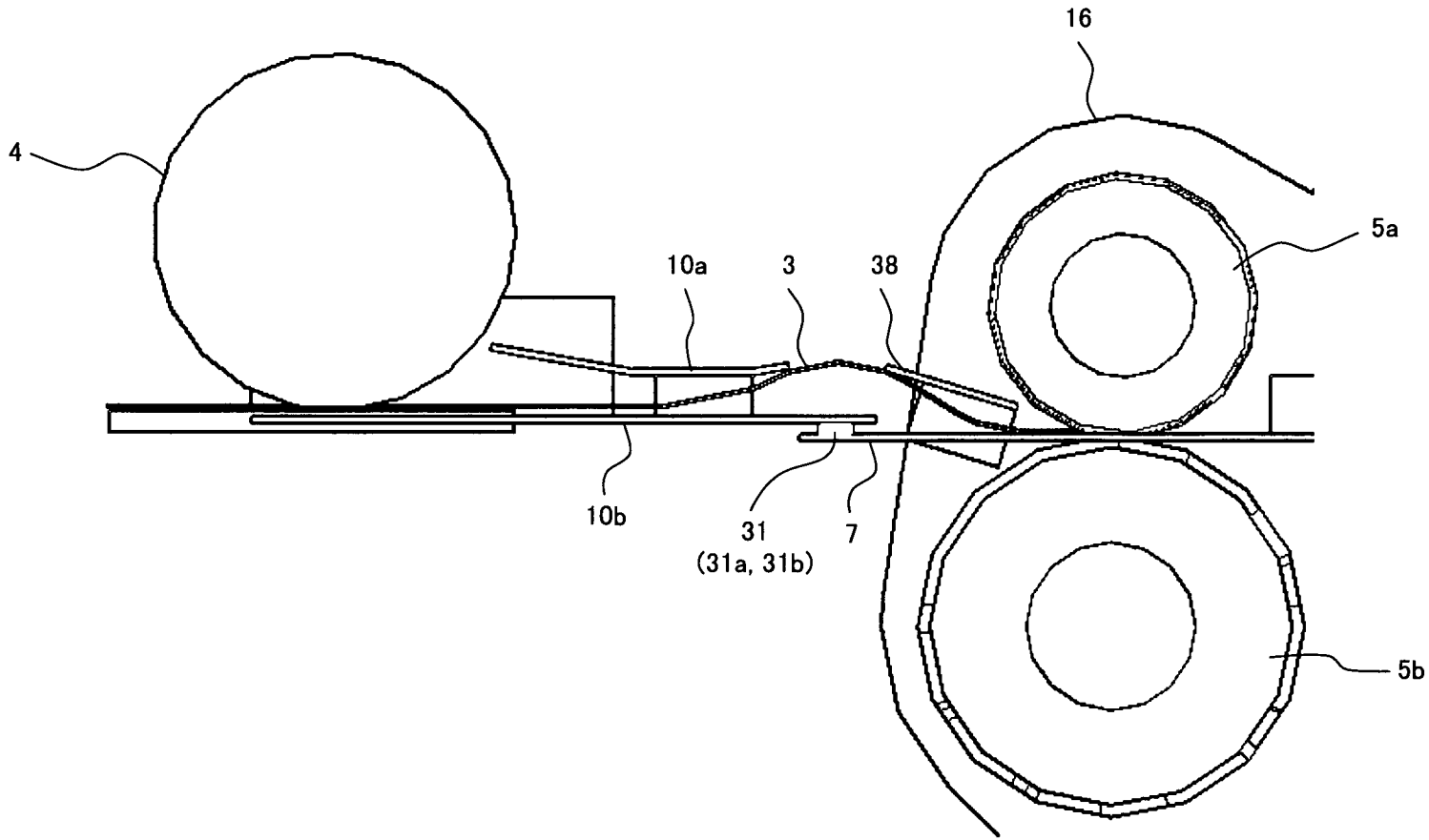
FIG. 5 shows the relationship between the paper feed unit and the resist roller pair shown in FIG. 4.

As shown in FIGS. 4 and 5, the resist guide 38, the feed guide 7, and the resist roller pair 5 are held by a support frame (platen frame) 16 of the belt platen 6.

Figure 6:
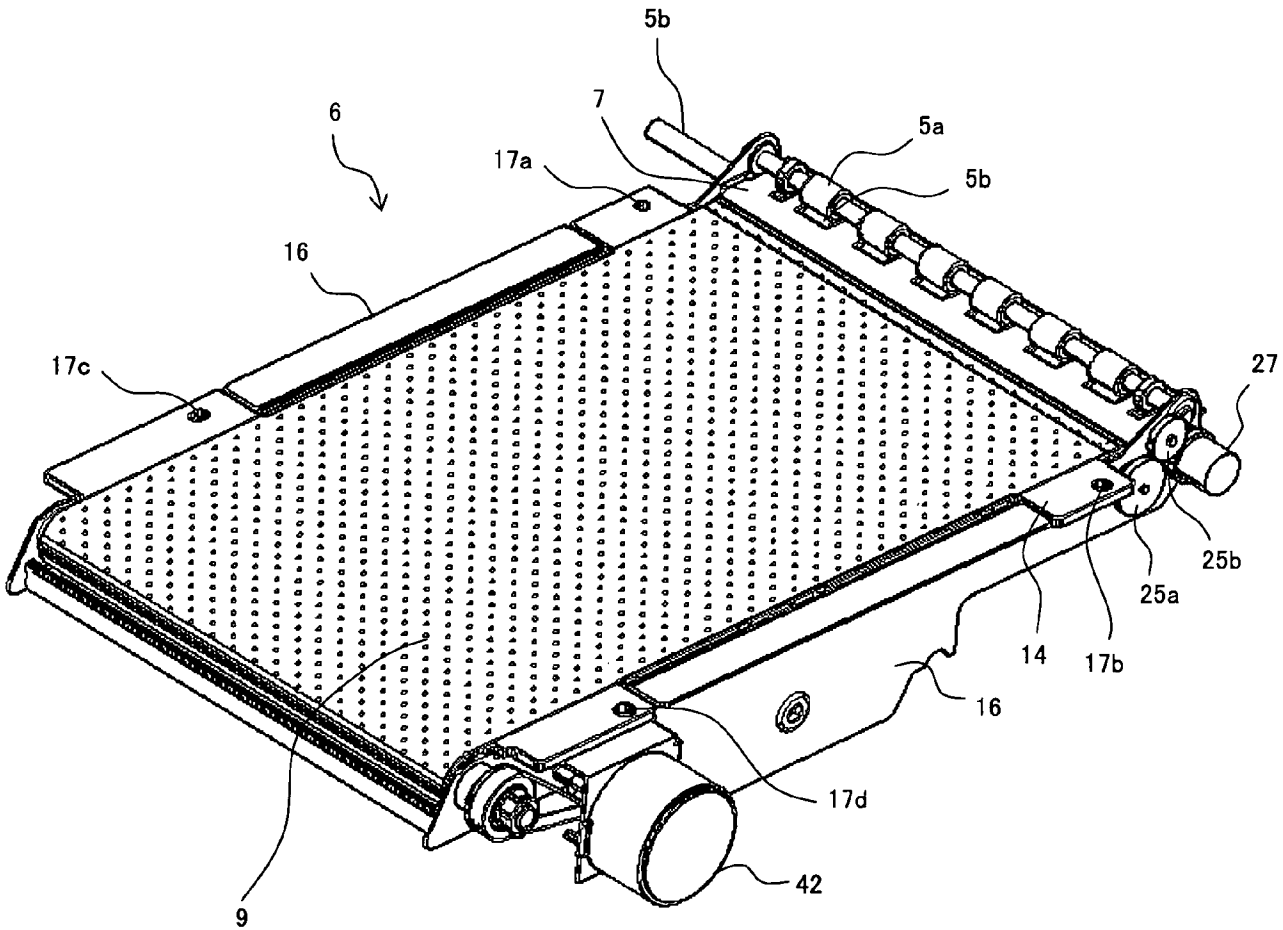
FIG. 6 is an oblique view of the belt platen shown in FIG. 5 and viewed from above.
Figure 7:
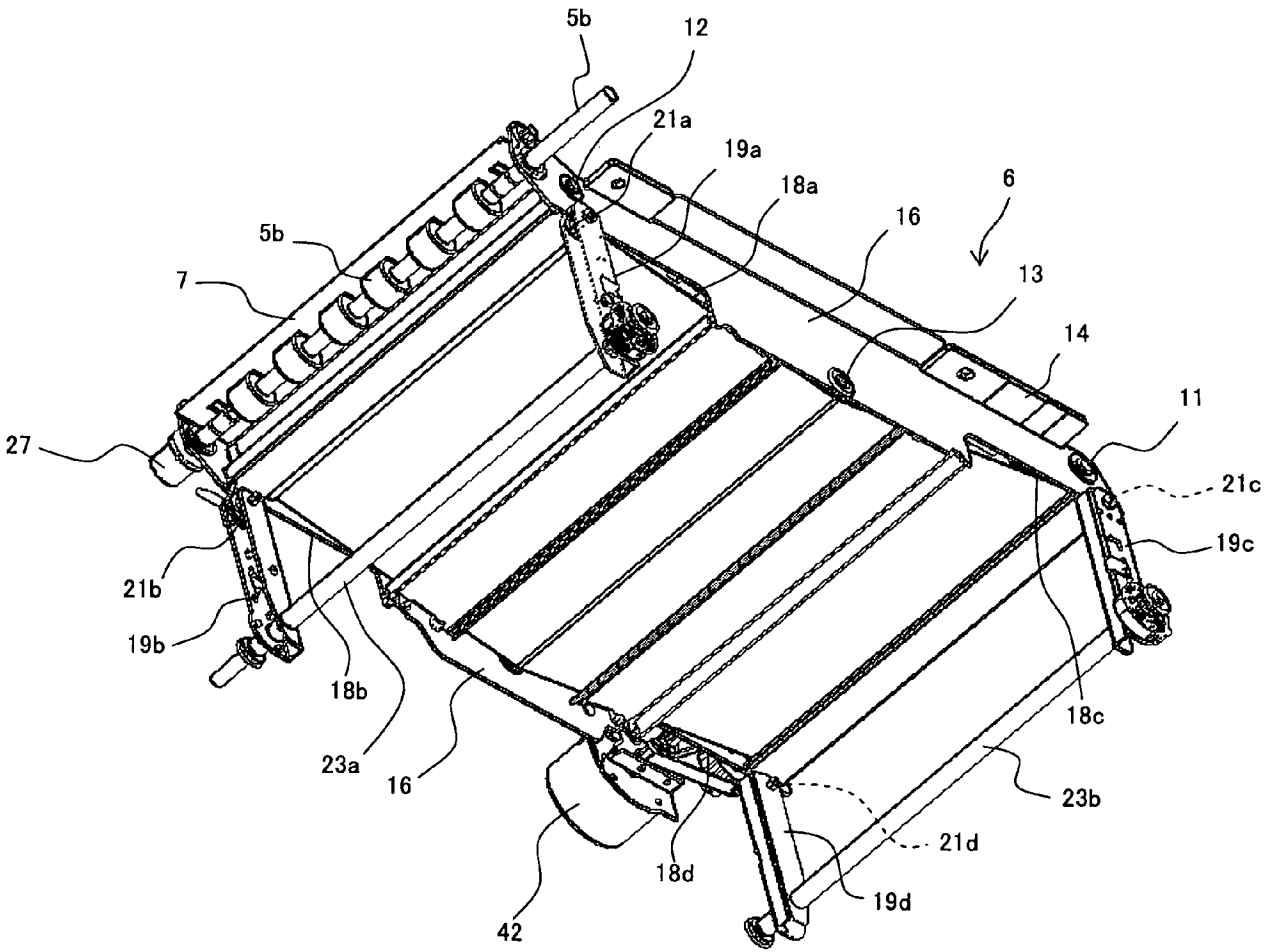
FIG. 7 is an oblique view of the belt platen shown in FIG. 5 and viewed from below.

As shown in FIGS. 6 and 7, a resist clutch 27 is held at one end portion of the axis of the resist roller 5*b*. The resist clutch 27 is connected to a driven roller 12 (FIG. 1) through gears 25*a* and 25*b*. Then the rotation force of the driven roller 12 of the belt platen 6 is transmitted to the resist roller 5*b* through the resist clutch 27 so that the resist roller 5*b* can be driven and rotate.

As shown in FIG. 1, a driving roller 11, the driven roller 12, a tension roller 13, and a platen 14 are attached to the platen frame 16, and they form the belt platen 6.

An endless belt 9 is put on over the driving roller 11, the driven roller 12, and the tension roller 13, and a number of holes (for suction to paper) are made in the belt 9.

In the belt 9, the tension roller 13 arranged inside the belt at substantially the center of the lower circulation unit urges the lower circulation unit of the belt 9 toward outside. Thus, the belt 9 is stretched over the three rollers (11, 12, and 13). When a belt motor 42 (FIGS. 6 and 7) rotates for drive, the driving roller 11 is rotated, and the belt 9 is driven by the rotation of the roller.

The platen 14 is provided at the upper circulation unit between the driving roller 11 and the driven roller 12 to form a paper feed plane. The platen 14 is a planar member having a number of holes, and is mounted inside the belt 9. The platen 14 is provided with positioning holes 17*a*, 17*b*, 17*c*, and 17*d* as bearing units for regulating the positions of a head frame 8 and the belt platen 6 as shown in FIG. 6. The positioning hole 17*a* is provided at the upstream in the paper feed direction of the platen 14. The positioning hole 17*c* is provided at the downstream in the paper feed direction of the positioning hole 17*a*. The positioning hole 17*c* is provided at the downstream in the paper feed direction of the positioning hole 17*a*.

The positioning holes 17*b* and 17*d* are provided opposite the positioning holes 17*a* and 17*c*.

The positioning hole 17*a* is nearly circular and a positioning pin 37*a* described later is engaged therein. A positioning pin 37*c* described later is engaged in the positioning hole 17*c* in the direction orthogonal to the paper feed direction, and the positioning hole 17*c* is an oval having idle space in the direction parallel to the paper feed direction. The positioning holes 17*b* and 17*d* are large holes having idle space with respect to the outlines of positioning pins 37*b* and 37*d* described later.

Suction fans 15*a* and 15*b* are provided below the platen 14. Using the suction fans 15*a* and 15*b*, the paper 3 can be adsorbed to the paper feed plane and fed through the platen 14 and a plurality of holes of the belt 9.

The platen 14 is processed at a predetermined plane level so that the paper 3 can be free of deviation in the feed path, and is fixed to the platen frame 16 with the plane level maintained. Both ends of the driving roller 11 and the driven roller 12 are held by the platen frame 16 such that axis directions can be parallel to each other and the rollers can rotate.

The tension roller 13 applies tension to the belt 9, and is held by and rotated on the platen frame 16 in an adjustable state for the deviation (to left or right substantially perpendicularly to the feed direction) of the belt 9 by the adjusting mechanism although they are not shown in the attached drawings.

On the other hand, the above-mentioned resist roller pair 5 is also held by and rotated on the platen frame 16 with their axes directed parallel to the axes of the driving roller 11 and the driven roller 12. The resist guide 38 and the feed guide 7 are also fixed to the platen frame 16 at the positions at which the paper 3 fed from the supply guide pair 10 can be further fed from the resist roller pair 5 to the belt 9. In the mode for embodying the present invention, the resist roller pair 5, the resist guide 38, and a feed guides 37 are held and fixed to the same platen frame 16, but can also be held by another extending frame extending from the support frame 16 not shown in the attached drawings.

Four up-and-down arms 19 (19*a*, 19*b*, 19*c*, 19*d*) are provided as displacement mechanisms for moving up and down the belt platen 6 at a lower brims 18 (18*a*, 18*b*, 18*c*, 18*d*) formed below the platen frame 16 in the belt platen 6 (refer to FIG. 7). Rollers 21 (21*a*, 21*b*, 21*c*, 21*d*) are provided at the tips of the four up-and-down arms 19 (19*a*, 19*b*, 19*c*, 19*d*). The rollers 21 (21*a*, 21*b*, 21*c*, 21*d*) respectively contact the lower brims 18 (18*a*, 18*b*, 18*c*, 18*d*).

The up-and-down arms 19*a* and 19*b* are held to an arm axis 23*a* held and rotated on the apparatus body frame 22. The up-and-down arms 19*c* and 19*d* are held to an arm axis 23*b* similarly held and rotated by the apparatus body frame 22. The arm axis 23*a* is connected to an up-and-down drive source not shown in the attached drawings, and the arm axis 23*b* is operated in synchronization with the arm axis 23*a* through a drive transmission system not shown in the attached drawings. The arm axis 23*b* is configured to rotate on the rotation axis in the opposite direction of the arm axis 23*a*.

That is, when the arm axis 23*a* and the arm axis 23*b* synchronously rotate in the arrow α and β directions as shown in FIG. 1, the four up-and-down arms 19 (19*a*, 19*b*, 19*c*, 19*d*) rotate and move from the horizontal position (saved position) indicated by the broken lines to the vertical position indicated by the solid lines as shown in FIG. 1. At this time, each of the rollers 21 (21*a*, 21*b*, 21*c*, 21*d*) of the up-and-down arms 19 (19*a*, 19*b*, 19*c*, 19*d*) moves while contacting the lower brims 18 (18*a*, 18*b*, 18*c*, 18*d*) of the platen frame 16. Thus, the belt platen 6 moves upward vertically.

When the arm axes 23*a* and 23*b* synchronously rotate in the opposite directions of the arrow α and β directions from the above-mentioned state, the four up-and-down arms 19 (19*a*, 19*b*, 19*c*, 19*d*) rotate and move from the vertical position indicated by the solid lines to the horizontal position indicated by the broken lines as shown in FIG. 1. At this time, each of the rollers 21 (21*a*, 21*b*, 21*c*, 21*d*) of the up-and-down arms 19 (19*a*, 19*b*, 19*c*, 19*d*) move while contacting the lower brims 18 (18*a*, 18*b*, 18*c*, 18*d*) of the platen frame 16. Thus, the belt platen 6 moves downward vertically.

Thus, the belt platen 6 is not fixed to the apparatus body frame 22, but is loaded on and held by the four up-and-down arms 19 (19*a*, 19*b*, 19*c*, 19*d*). Thus, although there arises a distortion in the apparatus body frame 22 depending on the ambient conditions such as transportation, there is no possibility of undesired influence such as a large distortion etc. occurring directly in the belt platen 6, thereby guaranteeing the accuracy of the belt platen 6.

The position of the belt platen 6 when the four up-and-down arms 19 (19*a*, 19*b*, 19*c*, 19*d*) move vertically and set in the vertical position is set as the position of forming an image when feeding the paper 3 while adsorbing it to the paper feed surface (upper circulation unit of the belt 9) of the belt platen 6.

Simultaneously, when the belt platen 6 is set at the position of forming the image is formed as shown in FIG. 5, the upper surfaces of projections 31 (31*a*, 31*b*) provided on both sides of the feed guide 7 held by the belt platen 6 contact the lower surfaces of the supply guide 10*b*. Thus, the supply guide 10*b* swings on the guide pins 20 (20*a*, 20*b*), the supply guide 10*b* is urged by an urging device such as a spring not shown in the attached drawings toward the feed guide 7, and the position in the height direction (Z direction) is determined.

To stably feed the paper 3 to the nip position of the resist roller pair 5, it is desired that the paper 3 is led to the vicinity of the nip position. To attain this, the feed guide 7 and the resist guide 38 for leading the paper 3 near the nip position of the resist roller pair 5 are fixed to the belt platen 6, and the position between the resist roller pair 5, and the feed guide 7 and the resist guide 38 is kept constant. Thus, the paper 3 can be stably fed to the belt 9 from the supply guide pair 10 through the feed guide 7, resist guide 38, and the resist roller pair 5.

As shown in FIGS. 1 and 2, the head frame 8 is provided an ink heads 24*k*, 24C, 24*m* and 24*y* for jetting liquid ink of plural colors. In the mode for embodying the present invention, they are four colors, that is, black, cyan, magenta, and yellow respectively. The ink heads 24*k*, 24C, 24*m* and 24*y* are configured by one long head or a plurality of short heads such that each of them can have at least the same width as the paper 3.

These ink heads 24*k*, 24C, 24*m* and 24*y* and the head frame 8 configure a recording unit. The ink heads 24*k*, 24C, 24*m* and 24*y* are fixed and held at predetermined intervals in this order in parallel to the direction substantially orthogonal to the feeding direction of the paper 3, and in the feeding direction of the paper 3.

Figure 8:
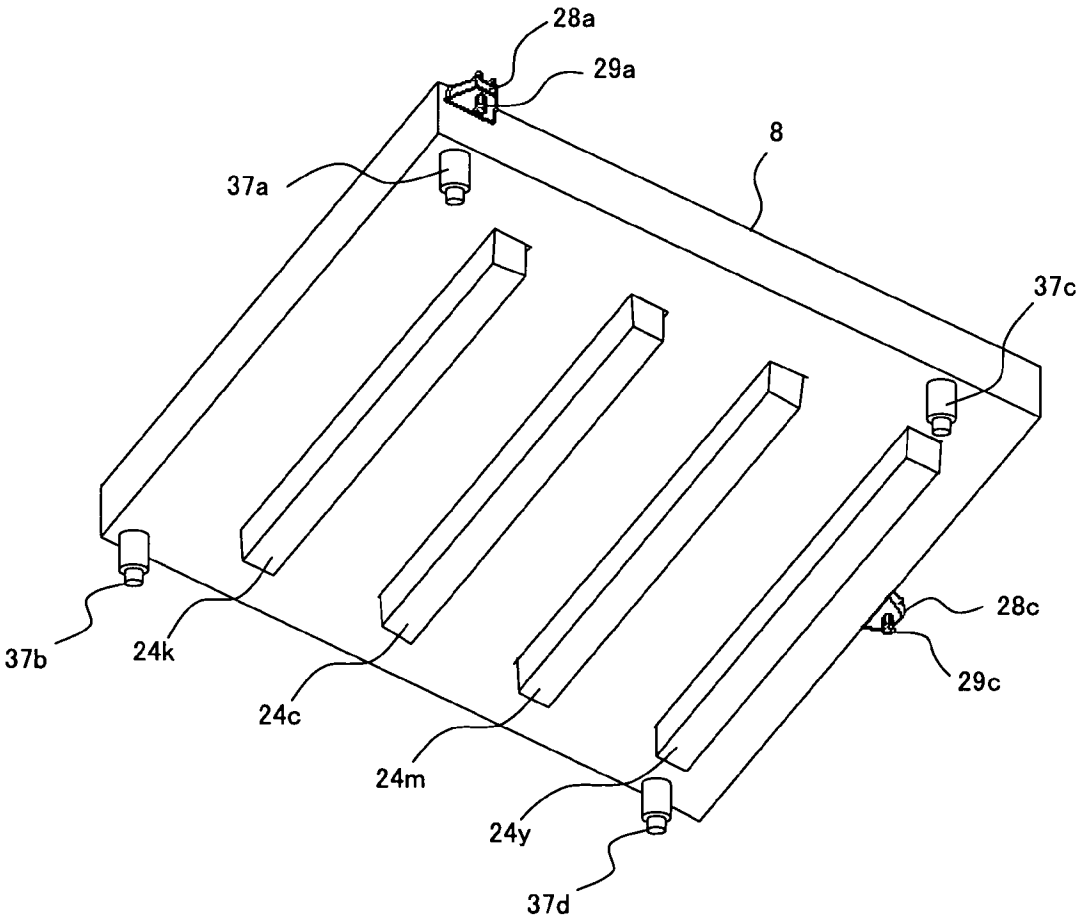
FIG. 8 is an oblique view of the head unit shown in FIG. 4 and viewed from below.

As shown in FIG. 1, the head frame 8 is arranged above and faces the belt platen 6. As shown in FIG. 8, the positioning pin 37*a* is fixed as an axis unit downward at the upstream in the paper feed direction below the head frame 8. The positioning pin 37*c* is fixed downward at the downstream in the paper feed direction of the positioning pin 37*a*.

Opposite the positioning pins 37*a* and 37*c* beyond the feed path of the paper 3, the positioning pins 37*b* and 37*d* are respectively fixed downward. The positioning pins 37*a*, 37*b*, 37*c*, and 37*d* have nail headed structures at their ends and respectively face the positioning holes 17*a*, 17*b*, 17*c*, and 17*d* formed on the platen 14.

The belt platen 6 is lifted by the rotating drive of the above-mentioned up-and-down arms 19*a*, 19*b*, 19*c*, and 19*d*, and when it is located at the image forming position, the positioning pins 37*a* and 37*c* are engaged in the positioning holes 17*a* and 17*c* of the platen 14, thereby positioning the head frame 8 and the platen 14 in the plane direction (X and Y directions). The positioning pins 37*b* and 37*d* are only inserted into the positioning holes 17*b* and 17*d* having idle space in the axis diameter direction, but have nothing to do with positioning in the X and Y directions. Furthermore, by the plane portions at the nail headed structures at the ends of the positioning pins 37*a*, 37*b*, 37*c*, and 37*d* coming in contact with the upper surface of the platen 14, the head frame 8 is lifted and held by the belt platen 6. Thus, the head frame 8 and the platen 14 are positioned in the vertical direction.

That is, the positioning pins 37*a*, 37*b*, 37*c*, and 37*d* and the positioning holes 17*a*, 17*b*, 17*c*, and 17*d* are configured as regulation members for regulating the relative positions between the recording unit and the belt platen 6.

In the mode for embodying the present invention, the positioning pins 37*a*, 37*b*, 37*c*, and 37*d* are provided for the head frame 8 and the positioning holes 17*a*, 17*b*, 17*c*, and 17*d* are provided for the belt platen 6, but the positioning pins can be provided for the belt platen and the positioning holes can be provided for the head frame. Thus, by the head frame 8 being held by the belt platen 6, the position of the belt platen 6 and the positions of the ink heads 24*k*, 24C, 24*m* and 24*y* can be regulated at appropriate positions for image forming.

Furthermore, as shown in FIG. 2, a total of three holding units 28 (28*a*, 28*b*, 28*c*) are formed as holding units for holding the head frame 8 to the apparatus body frame 22 at the side of the head frame 8.

In FIG. 1, only the holding unit 28*c* is shown. Positioning bosses 29 (29*a*, 29*b*, 29*c*) are fixed downward at these three holding units 28 (28*a*, 28*b*, 28*c*) as shown in FIG. 8.

Figure 9:
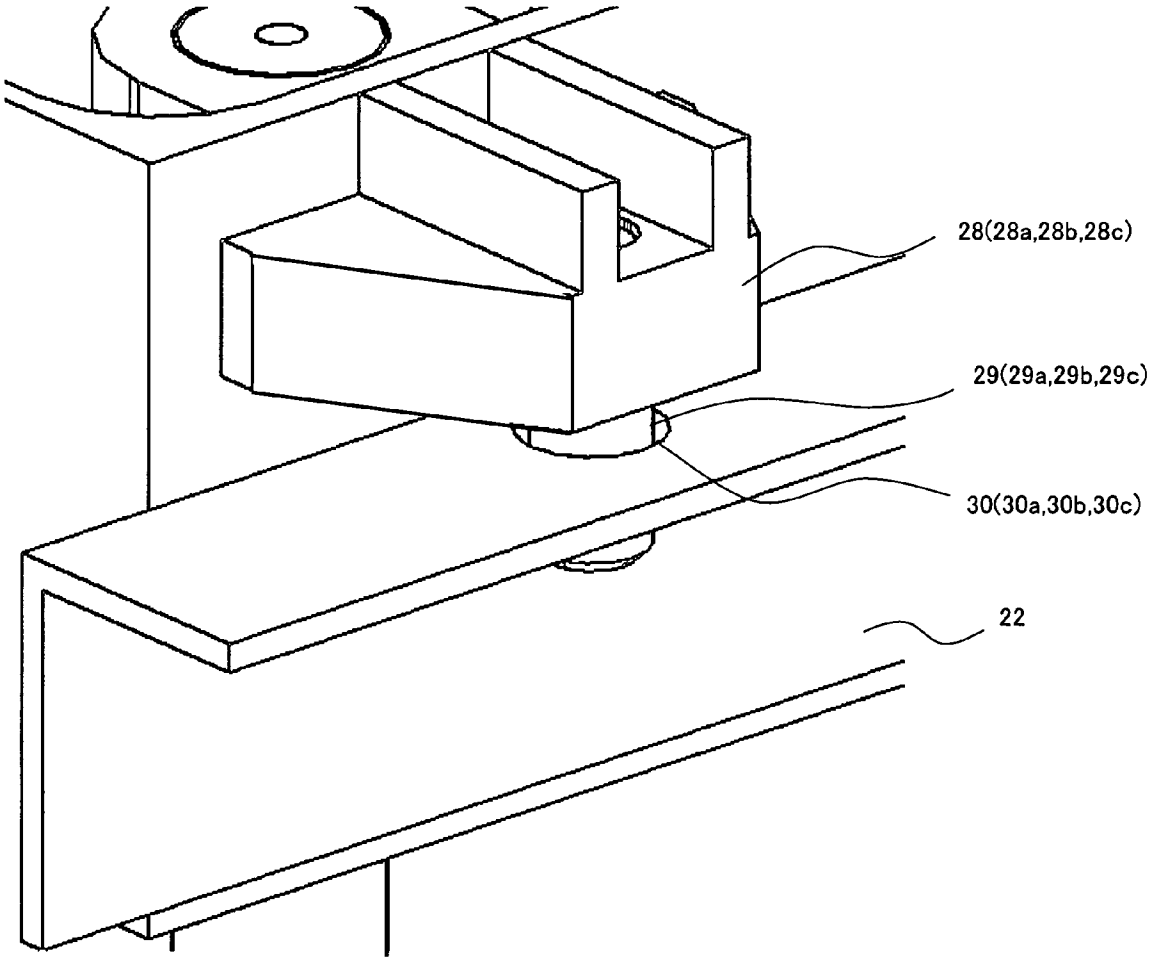
FIG. 9 shows the details of the head unit shown in FIG. 8 and the positioning and holding unit of the apparatus body frame.

Positioning holes 30 (30*a*, 30*b*, 30*c*) larger than the positioning bosses 29 (29*a*, 29*b*, 29*c*) are formed at in the apparatus body frame 22 the positions respectively corresponding to the positioning bosses 29 (29*a*, 29*b*, 29*c*) as shown in FIG. 9. The positioning bosses 29 are inserted into the positioning holes 30. In FIG. 9, only one portion is enlarged, but the other two portions are similarly structured.

Thus, for the head frame 8, the positioning bosses 29*a* and 29*b* closer to the resist roller pair 5 (upstream in the paper feed direction) and the positioning bosses 29*c* farther the resist roller pair 5 (downstream in the paper feed direction) are inserted into the positioning holes 30 (30*a*, 30*b*, 30*c*) formed in the apparatus body frame 22, and a free movement in the XY plane is kept for the gap between the positioning holes 30 (30*a*, 30*b*, 30*c*) and the positioning bosses 29 (29*a*, 29*b*, 29*c*).

The head frame 8 is held such that it can be moved vertically to the position where the bottoms of the holding units 28 (28*a*, 28*b*, 28*c*) come in contact with the upper surface of the apparatus body frame 22.

The holding units 28 (28*a*, 28*b*, 28*c*) are configured to have the rigidity of standing the total weight of the head frame 8 and each part.

Thus, the head frame 8 (that is, the recording unit) is not fixed to the apparatus body frame 22, but is held and moved thereon, thereby reducing the undesired influence such as a big distortion etc. in the head frame 8 although there can be a distortion in the apparatus body frame 22 by the ambient conditions such as transportation. Therefore, there is a small possibility that there occurs an error in the relative positions among the ink heads 24*k*, 24C, 24*m* and 24*y* fixed to the head frame 8 with high accuracy, and the possibility of undesired influence in printing accuracy can be reduced.

Next, as shown in FIG. 1, an eject roller pair 34 and an eject guide pair 36 are arranged on the feed path at the downstream of the belt platen 6. The eject guide pair 36 has a upper eject guide pair 36*a* and a lower eject guide 36*b* that face each other, and a distance appropriate for the passage of the paper 3 is maintained. Thus, the paper 3 fed from the belt platen 6 is carried between the upper eject guide 36*a* and the lower eject guide 36*b*, and stacked on an eject tray 35 by the eject roller pair 34.

Figure 10:
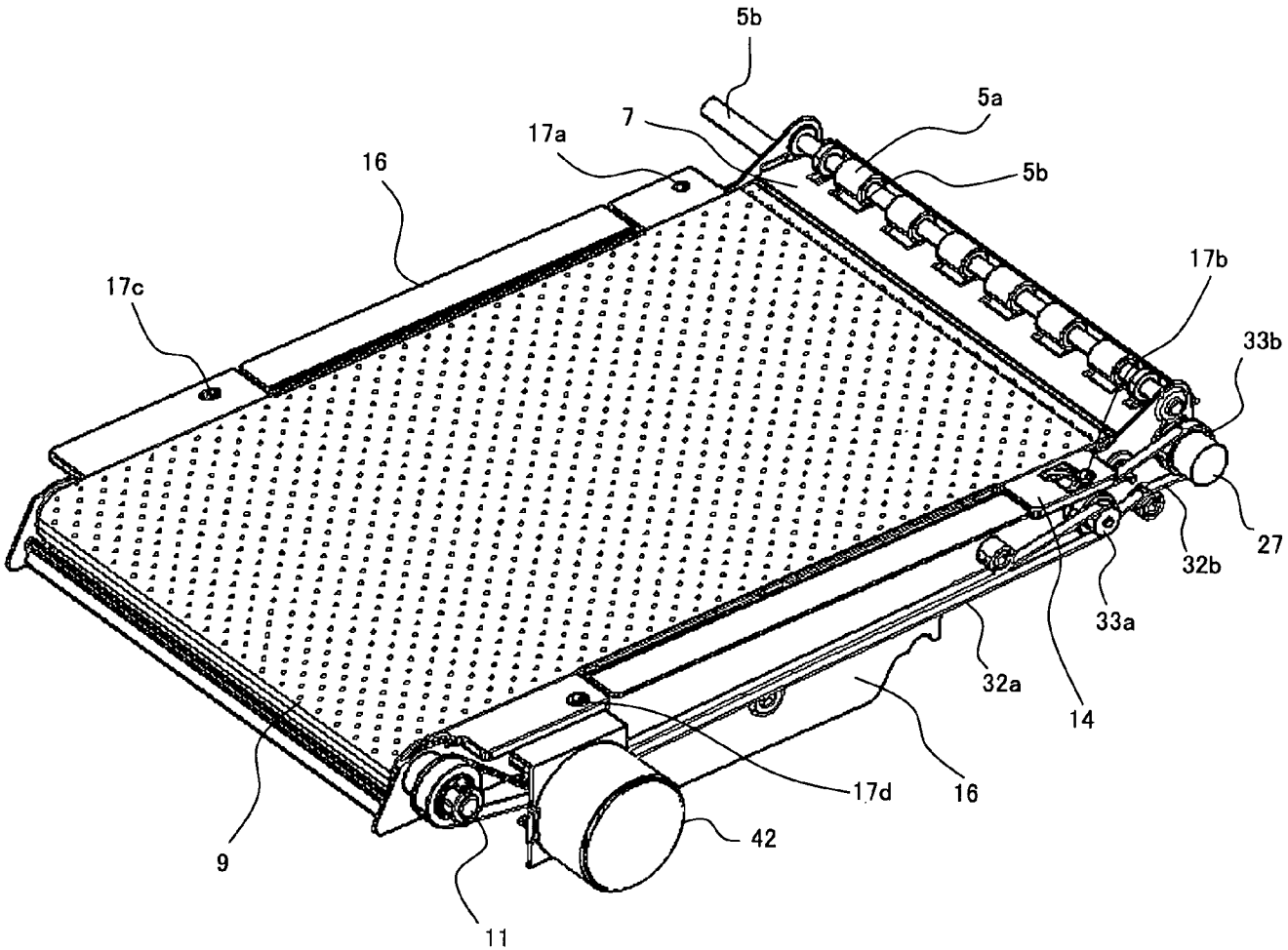
FIG. 10 is an oblique view showing the driving unit of the belt platen shown in FIG. 7.

In the mode for embodying the present invention, the driving force of the resist roller pair 5 is transmitted from the driven roller 12 through gears 25 (25*a*, 25*b*). However, for example, as shown in FIG. 10, the driving force can be obtained from the driving roller 11 through timing belts 32*a* and 32*b* and pulleys 33*a* and 33*b*. It is obvious that a dedicated drive source for driving the resist roller pair 5 can be provided.

(Description of the Operations)

Described below is the operations in the image forming apparatus 1 with the above-mentioned configuration.

When an instruction to form an image is input from the operation panel (not shown in the attached drawings) of the image forming apparatus 1, or when a signal of an instruction to form an image is input from host equipment not shown in the attached drawings but connected through a signal line, the control unit of the image forming apparatus 1 lifts the belt platen 6 by up-and-down arms 19 (19*a*, 19*b*, 19*c*, 19*d*) synchronously driven for rotation in the $\alpha$ direction and the $\beta$ direction. The positioning pins 37*a* and 37*c* fixed to the bottom surface of the head frame 8 are engaged in the positioning holes 17*a* and 17*c* formed in the platen 14 when the up-and-down arms 19 (19*a*, 19*b*, 19*c*, 19*d*) are vertical, and the head frame 8 and the belt platen 6 are positioned on the XY plane. Furthermore, when the up-and-down arms 19 (19*a*, 19*b*, 19*c*, 19*d*) are vertical, the flat portions at the nail headed structures at the ends of the positioning pins 37*a*, 37*b*, 37*c*, and 37*d* come in contact with the upper surface of the platen 14, and the head frame 8 is stacked and held by the belt platen 6. Thus, the distance between the head frame 8 and the belt platen 6 can be set to a predetermined appropriate print distance.

On the other hand, the feeding direction of the paper 3 by the resist roller pair 5 and the feeding direction of the paper 3 by the belt platen 6 are guaranteed by the mounting accuracy of the resist roller pair 5, the driving roller 11, and the driven roller 12 on the platen frame 16.

That is, by the positioning of the head frame 8 and the belt platen 6, the position accuracy of the resist roller pair 5, the driving roller 11, the driven roller 12, and the ink heads 24*k*, 24C, 24*m* and 24*y* can be finally guaranteed.

Then, after driving the resist roller pair 5, the driving roller 11, and the eject roller pair 34, the pickup roller 4 is driven.

Thus, the pickup roller 4 retrieves the top sheet of the paper 3 from the paper feed tray 2, and the paper 3 is fed between the supply guide 10*a* and the supply guide 10*b* at the upstream in the paper feed direction of the resist roller pair 5.

The paper 3 is led between the supply guide 10*a* and the supply guide 10*b*, passes between the resist guide 38 and the feed guide 7, and then reaches the nip position formed at the opposite unit between the resist roller 5*a* and the resist roller 5*b*.

At this time, the pickup roller 4 is driven and rotated, but the resist roller pair 5 temporarily stops rotating by the resist clutch 27. Thus, as shown in FIG. 5, the paper 3 fed toward the resist roller pair 5 contacts the nip position and temporarily stops. As a result, it is distorted, and the straightness of the paper 3 corrects the feeding posture at the nip position of the resist roller pair 5. That is, if there is deviation in the feed path, the deviation is corrected.

Then, after a predetermined time, the stop of the rotation by the resist clutch 27 is released, and the resist roller 5*b* starts rotating. By the resist roller 5*a* rotating after the rotation of the resist roller 5*b*, the paper 3 passes the feed guide 7, and is fed to the belt 9 of the belt platen 6 at a predetermined speed.

On the belt 9, the suction by the suction fans 15*a* and 15*b* is applied through a number of holes made in the platen 14 and a number of holes in the belt 9.

The paper 3 fed from the resist roller pair 5 to the belt 9 is fed in the X-axis direction at a predetermined speed while being adsorbed onto the belt 9 circulating by the drive of the belt motor 42.

Then, the paper 3 fed by the belt 9 of the belt platen 6 is fed below each of the ink heads 24*k*, 24C, 24*m* and 24*y* loaded and arranged on the head frame 8, and the drop of ink jetted from the ink heads 24*k*, 24C, 24*m* and 24*y*, thereby forming an image on the paper 3.

The paper 3 on which an image has been formed is led between the upper eject guide 36*a* and the lower eject guide 36*b*, ejected outside the apparatus by the eject roller pair 34, and stacked and stored on the eject tray 35.

According to the mode for embodying the present invention, since the resist roller pair 5 is held by the belt platen 6, the distortion of the apparatus body frame 22 does not generate the deviation in the feeding direction of the resist roller pair 5 and the belt 9, and realizes stable feed of the paper 3.

Relating to the position information about the ink heads 24*k*, 24C, 24*m* and 24*y* and the belt platen 6, each end portion of the head frame 8 is not fixed to the apparatus body frame 22, but is only loaded thereon.

That is, when the belt platen 6 is lifted and the up-and-down arms 19 (19*a*, 19*b*, 19*c*, 19*d*) are vertical, the positioning pins 37*a* and 37*c* fixed to the bottom surface of the head frame 8 are engaged in the positioning holes 17*a* and 17*c* formed in the platen 14, and the head frame 8 and the belt platen 6 are positioned in the XY plane direction.

Furthermore, when the up-and-down arms 19 (19*a*, 19*b*, 19*c*, 19*d*) are vertical, the flat portions at the nail headed structures at the ends of the positioning pins 37*a*, 37*b*, 37*c*, and 37*d* contact the upper surface of the platen 14, and the head frame 8 is held by the belt platen 6, thereby setting the distance between the ink heads 24*k*, 24C, 24*m* and 24*y* and the belt platen 6 to a predetermined appropriate printing distance.

That is, when an image is formed, the head frame 8 is positioned and held directly by the belt platen 6. Therefore, the position accuracy between the belt platen 6 and the ink heads 24*k*, 24C, 24*m* and 24*y* held and fixed to the head frame 8 can be maintained. Thus, by the belt platen 6 holding the resist roller pair 5, the position accuracy in the feeding direction between the belt 9 and the resist roller pair 5 can also be maintained, and finally the position accuracy between the ink heads 24*k*, 24C, 24*m* and 24*y* and the resist roller pair 5 can be maintained.

Therefore, although there is a distortion occurring in the apparatus body frame 22 by a transportation condition etc., the position accuracy among the head frame 8, the belt platen 6, the ink heads 24*k*, 24C, 24*m* and 24*y* and the resist roller pair 5 can be maintained, and a high quality image forming apparatus can be provided.

The feed path of paper from the paper feed tray 2 to the resist roller pair 5 when the belt platen 6 is located at the image forming position is positioned by the feed guide 7 fixed to the belt platen 6 urging the supply guide pair 10 at the upstream in the paper feed direction held by and swung on the apparatus body frame 22. Thus, the position accuracy of the feed path from the paper feed tray 2 to the resist roller pair can be guaranteed.

In the assembly, when the resist roller pair 5 and the belt platen 6 are separately held by the apparatus body frame 22, it is necessary to adjust the feeding direction of the paper 3 by the resist roller pair 5 and the feeding direction of the paper 3 by the belt 9 after the apparatus is completely assembled. However, by holding the resist roller pair 5 by the belt platen 6, it is only necessary to make an adjustment before the assembly of the apparatus to match the feeding direction of the resist roller pair 5 and the belt platen 6 and no adjustment is necessary in the assembled state.

Furthermore, by holding the resist roller pair 5 by the belt platen 6, the belt drive source of the belt platen 6 can be shared with the resist roller pair 5, thereby reducing the cost.

Second Mode for Embodying the Present Invention

FIGS. 11 through 22 show the outline of the configuration of the image forming apparatus according to the second mode for embodying the present invention.

The portions the same as or corresponding to the portions according to the first mode for embodying the present invention are assigned the same reference numerals in the following descriptions. In the entire operations, it is assumed that the feeding direction of a recording medium is an X-axis direction (secondary scanning direction), the direction orthogonal to the feeding direction the width direction of the recording medium or a Y-axis direction (primary scanning direction), and the direction orthogonal to the XY plane is a Z direction.

Figure 11:
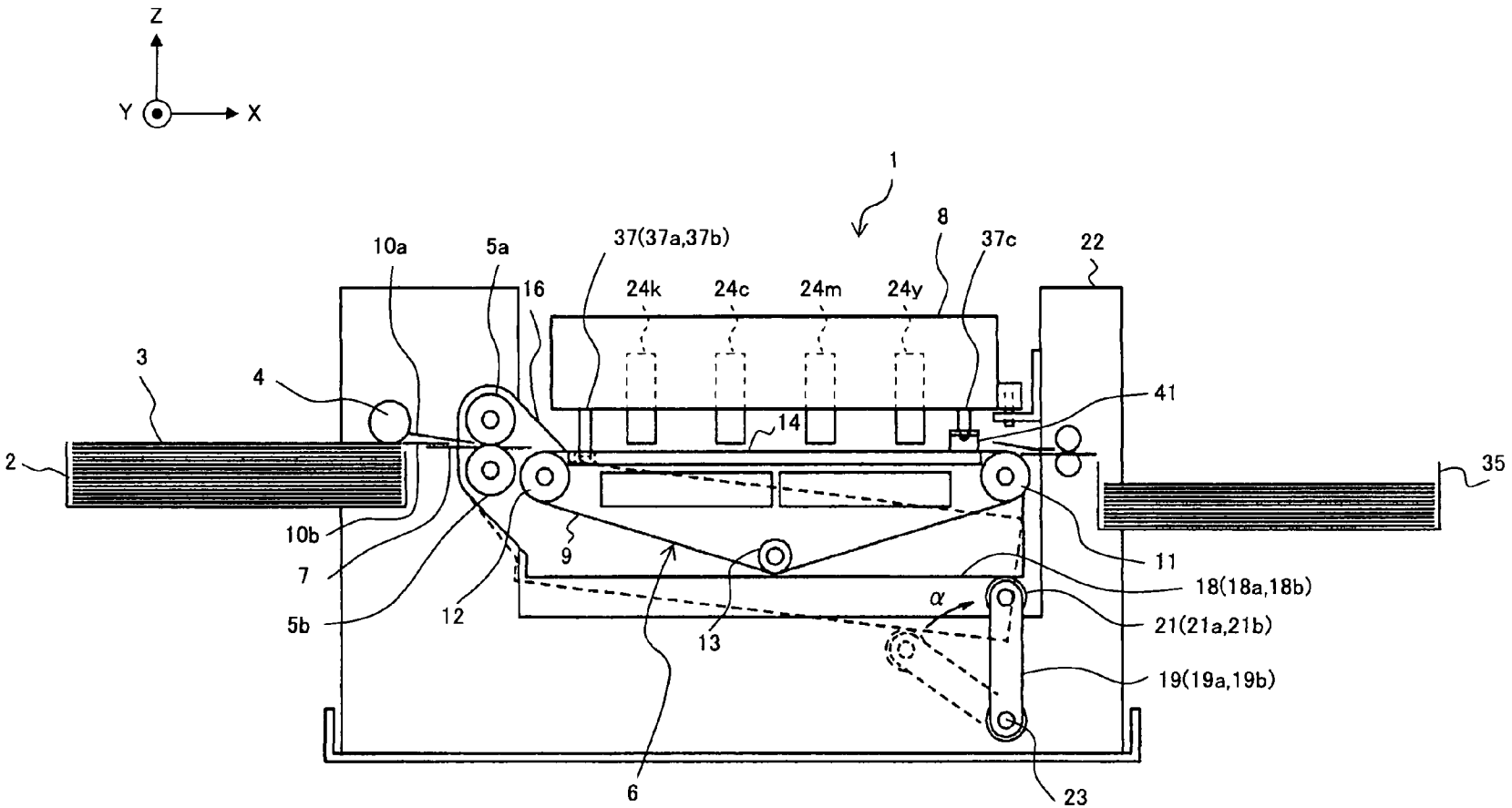
FIG. 11 is a sectional side view of an image forming apparatus according to the second mode for embodying the present invention.

As shown in FIG. 11, from the pickup roller 4 to the resist roller pair 5, that is, from the upstream to the downstream of the paper feed, the supply guide pair 10 for leading the paper 3 fed from the pickup roller 4 to the resist roller pair 5 is provided. The supply guide pair 10 has an upper supply guide 10*a* and a lower supply guide 10*b*. The supply guide 10*a* and the supply guide 10*b* are arranged at appropriate intervals for the feed of the paper 3. A feed guide 7 is provided between the supply guide pair 10 and the belt platen 6.

The upper supply guide 10*a* is extended toward above the feed guide 7. To stably rush the paper 3 to a nip position of the resist roller pair 5, it is designed such that the gap to the feed guide 7 can be narrowed toward the nip position.

That is, the upper supply guide 10*a* is tilted with respect to the feed guide 7, and is extended to the vicinity of the nip position of the resist roller pair 5. Thus, the paper 3 is stably fed from the pickup roller 4 to the resist roller pair 5, the feeding posture such as deviation in a feed path etc. is forcibly corrected by the resist roller pair 5, thereby feeding the paper 3 to the belt platen 6.

Figure 12:
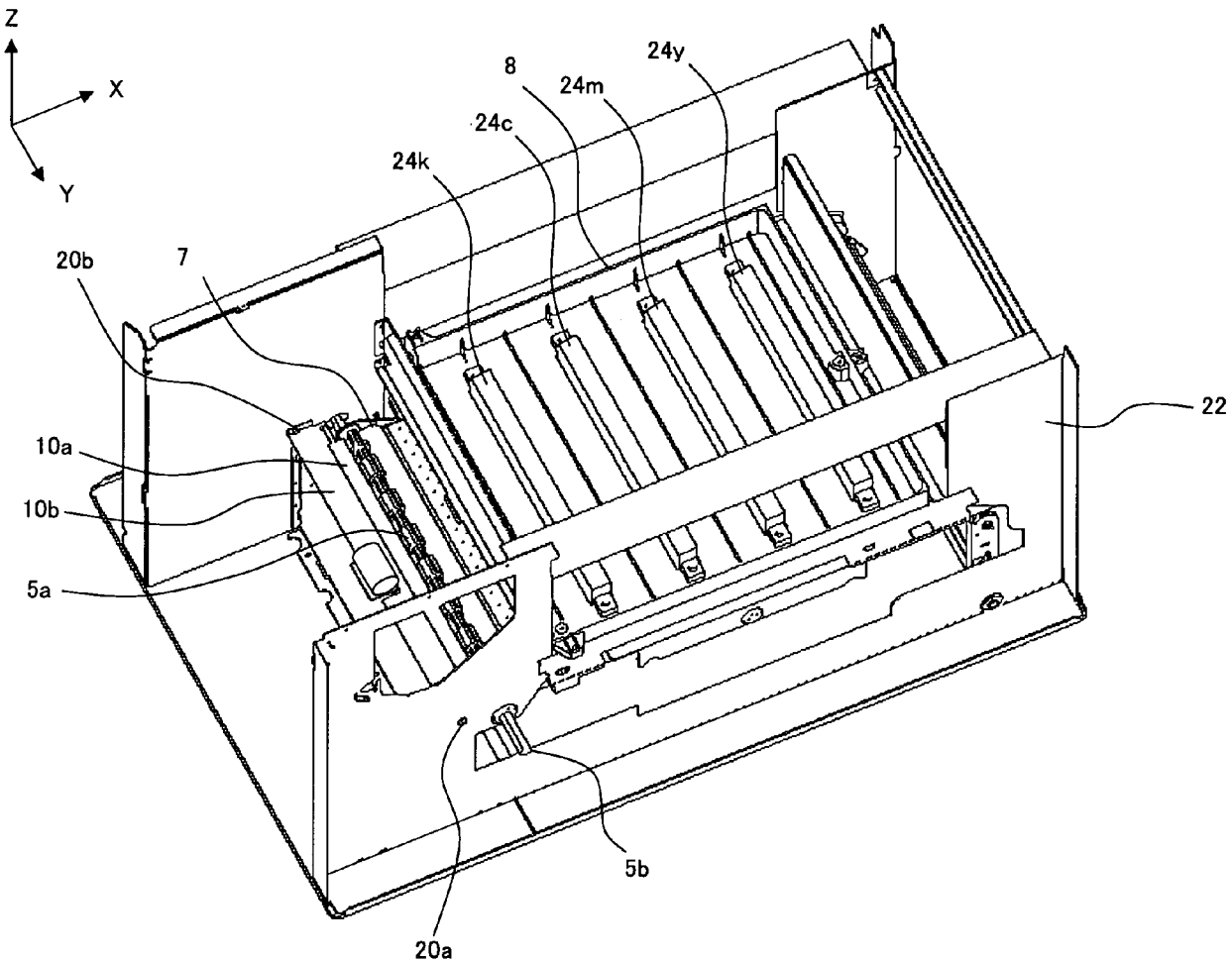
FIG. 12 is a view from obliquely above the front of the image forming apparatus.

As shown in FIG. 12, the supply guide pair 10 is held to and swung on the apparatus body frame 22 through the guide pins 20*a* and 20*b* provided at the side of the lower supply guide 10*b*. The upper supply guide 10*a* is fixed to the lower supply guide 10*b*.

The supply guide pair 10 is held to and swung on the guide pins 20 (20*a*, 20*b*), but is not swung at or in excess of a predetermined angle by the stopper not shown in the attached drawings, and an urging device such as a spring etc. not shown in the attached drawings urges the feed guide 7.

Figure 14:
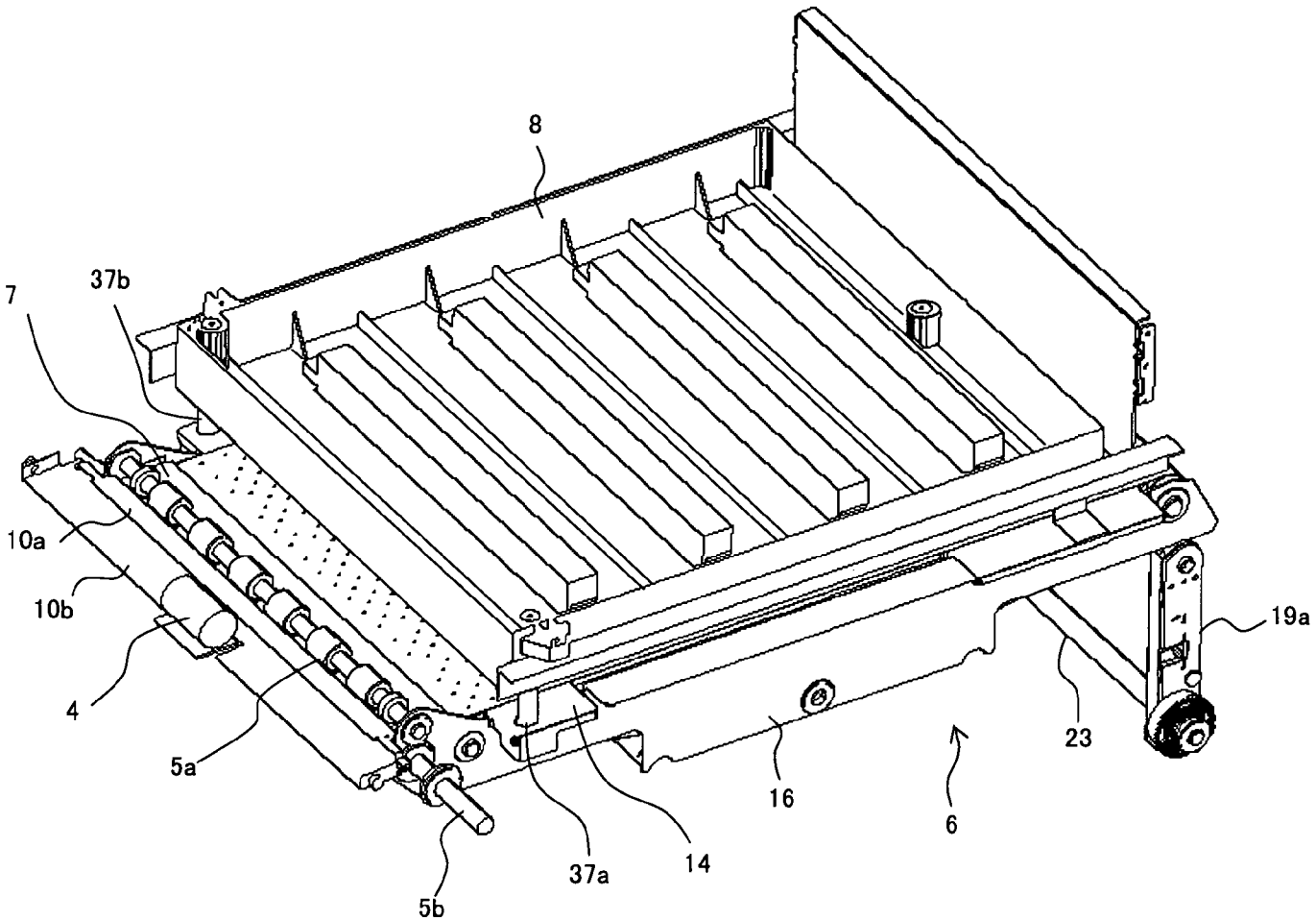
FIG. 14 is an oblique view of the positioned head unit and belt platen shown in FIG. 4 (positions of the feeding unit and the recording unit)
Figure 15:
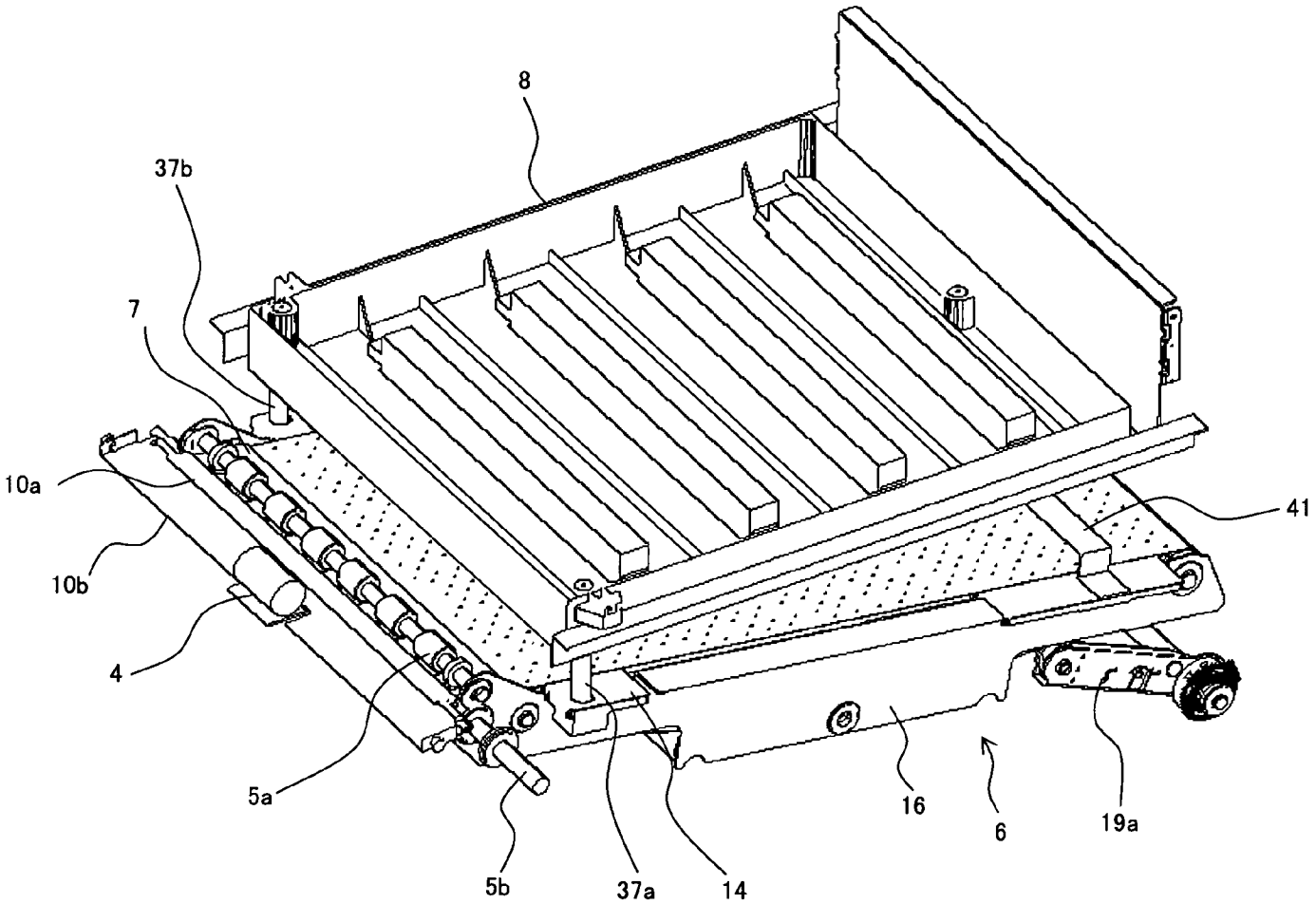
FIG. 15 is an oblique view in which the belt platen is saved from the head unit shown in FIG. 14 (position of the saved feeding unit)

As shown in FIGS. 14 and 15, the feed guide 7 and the resist roller pair 5 are held to the platen frame 16 of the belt platen 6. The lower resist roller 5*b* is held to at both ends and rotated on the apparatus body frame 22 (refer to FIG. 12).

Figure 13:
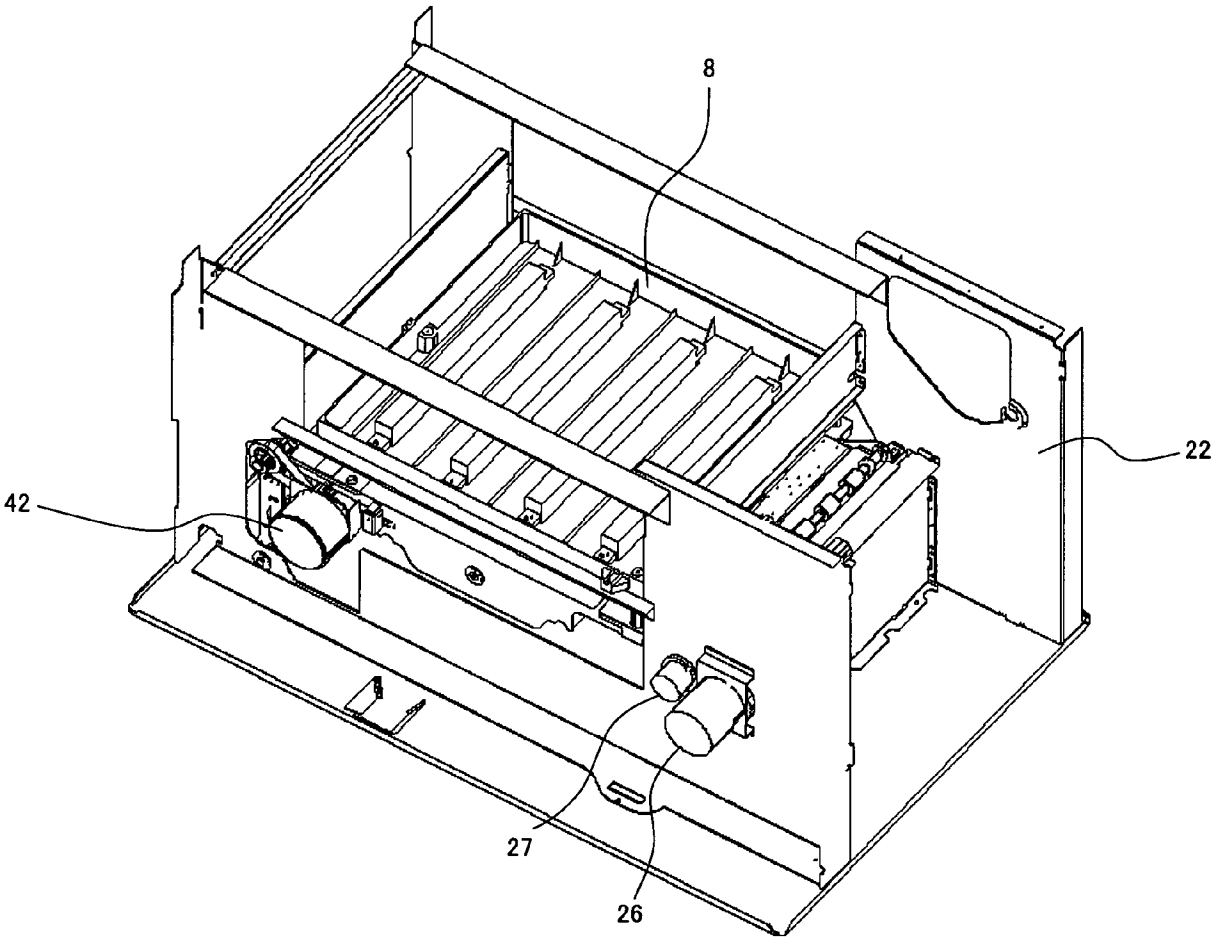
FIG. 13 is a view from obliquely above the back of the image forming apparatus.

At one end of the resist roller 5*b*, the resist clutch 27 is held as shown in FIG. 13, and connected to a resist motor 26 fixed to the apparatus body frame 22 through a gear. Using the resist motor 26, the resist roller 5*b* is driven for rotation.

As shown in FIG. 11, the belt 9, the driving roller 11, the driven roller 12, and the platen 14 are attached to the platen frame 16, and form the belt platen 6.

Figure 16:
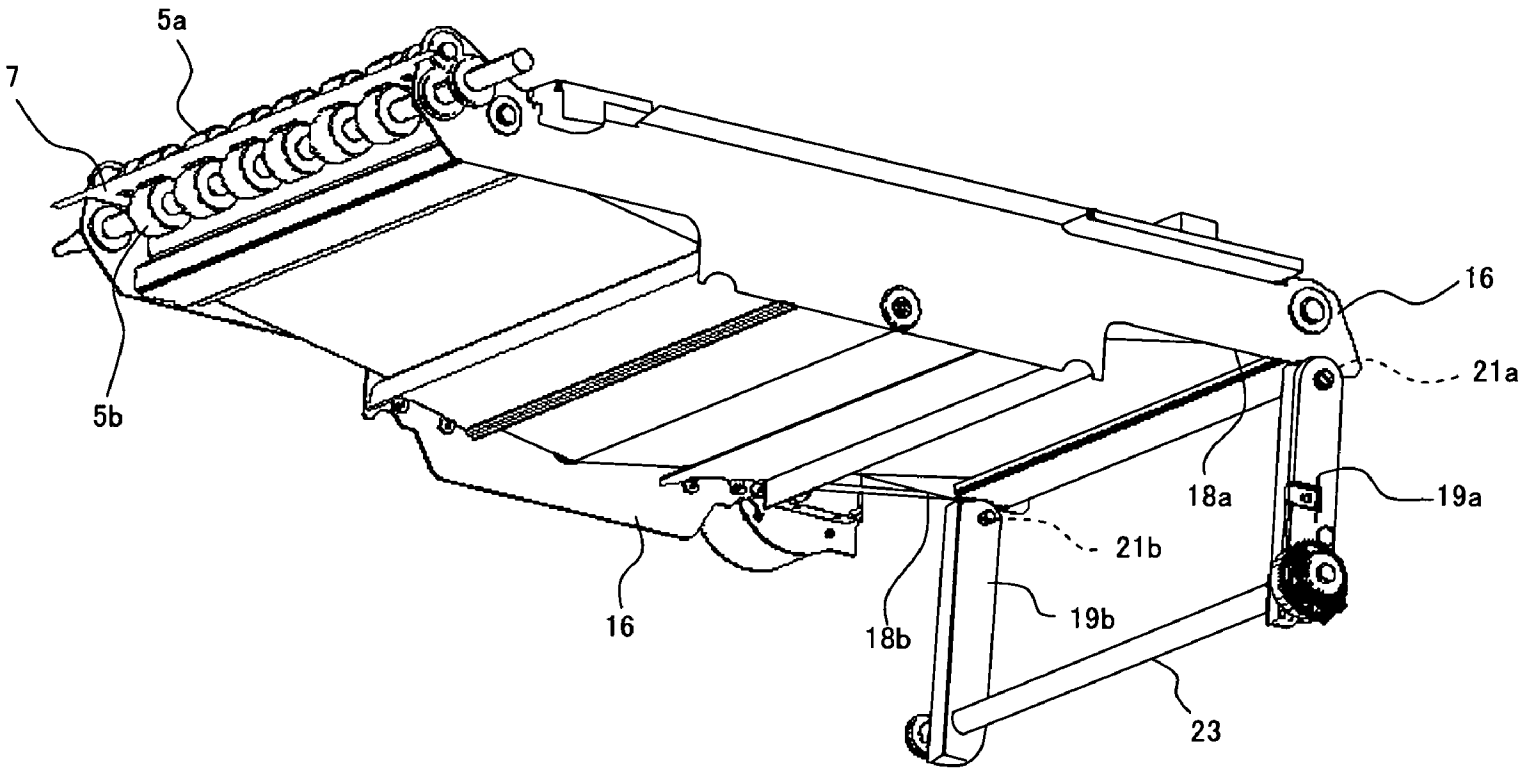
FIG. 16 is an oblique view of the belt platen shown in FIG. 15 and viewed from below.

As shown in FIG. 16, each of the rollers 21 (21*a*, 21*b*) at the tips of the two up-and-down arms 19 (19*a*, 19*b*) as mechanisms for swing the belt platen 6 come into contacts the lower brims 18 (18*a*, 18*b*) formed below the platen frame 16 of the belt platen 6.

The up-and-down arms 19 (19*a*, 19*b*) are held to the arm axis 23 held to and rotated on the apparatus body frame 22, and the arm axis 23 is connected to the up-and-down drive source not shown in the attached drawings.

As shown in FIG. 11, when the arm axis 23 rotates in the arrow α direction, the two up-and-down arms 19 (19*a*, 19*b*) rotate and move from the horizontal position (saved position) indicated by the broken lines to the vertical position indicated by the solid lines. At this time, each of the rollers 21 (21*a*, 21*b*) of the up-and-down arms 19 (19*a*, 19*b*) moves while contacting the lower brims 18 of the platen frame 16.

The resist roller 5*b* held to the belt platen 6 is rotated on and held to the apparatus body frame 22, and when the arm axis 23 is rotated in the arrow α direction, the belt platen 6 is swung on the axis of the resist roller 5*b* as a rotation center.

When the arm axis 23 is rotated from the current state in the opposite direction of the arrow α direction, the two up-and-down arms 19 (19*a*, 19*b*) moves and rotates from the vertical position indicated by the solid lines to the position indicated by the broken lines. At this time, each of the rollers 21 (21*a*, 21*b*) of the up-and-down arms 19 (19*a*, 19*b*) moves while contacting the lower brims 18 (18*a*, 18*b*) of the platen frame 16. Thus, the belt platen 6 swung in the direction of lowering the downstream of the paper feed on the axis of the resist roller 5*b* as a rotation center.

Thus, the belt platen 6 is configured such that the axis of the resist roller 5*b* can be held and rotated with respect to the apparatus body frame 22 with the other side loaded on and held to the two up-and-down arms 19 (19*a*, 19*b*). That is, since the belt platen 6 is not completely fixed to the apparatus body frame 22, there is a small possibility that an undesired influence such as a large distortion occurs directly on the belt platen 6 although there occurs a distortion on the ambient conditions such as a transportation condition etc., thereby guaranteeing the accuracy of the belt platen 6.

The position of the belt platen 6 when the two up-and-down arms 19 (19*a*, 19*b*) move to be vertical and set upright is set as the position of forming an image while adsorbing and feeding the paper 3 on the upper surface (upper circulation unit of the belt 9) of the belt platen 6.

Figure 18:
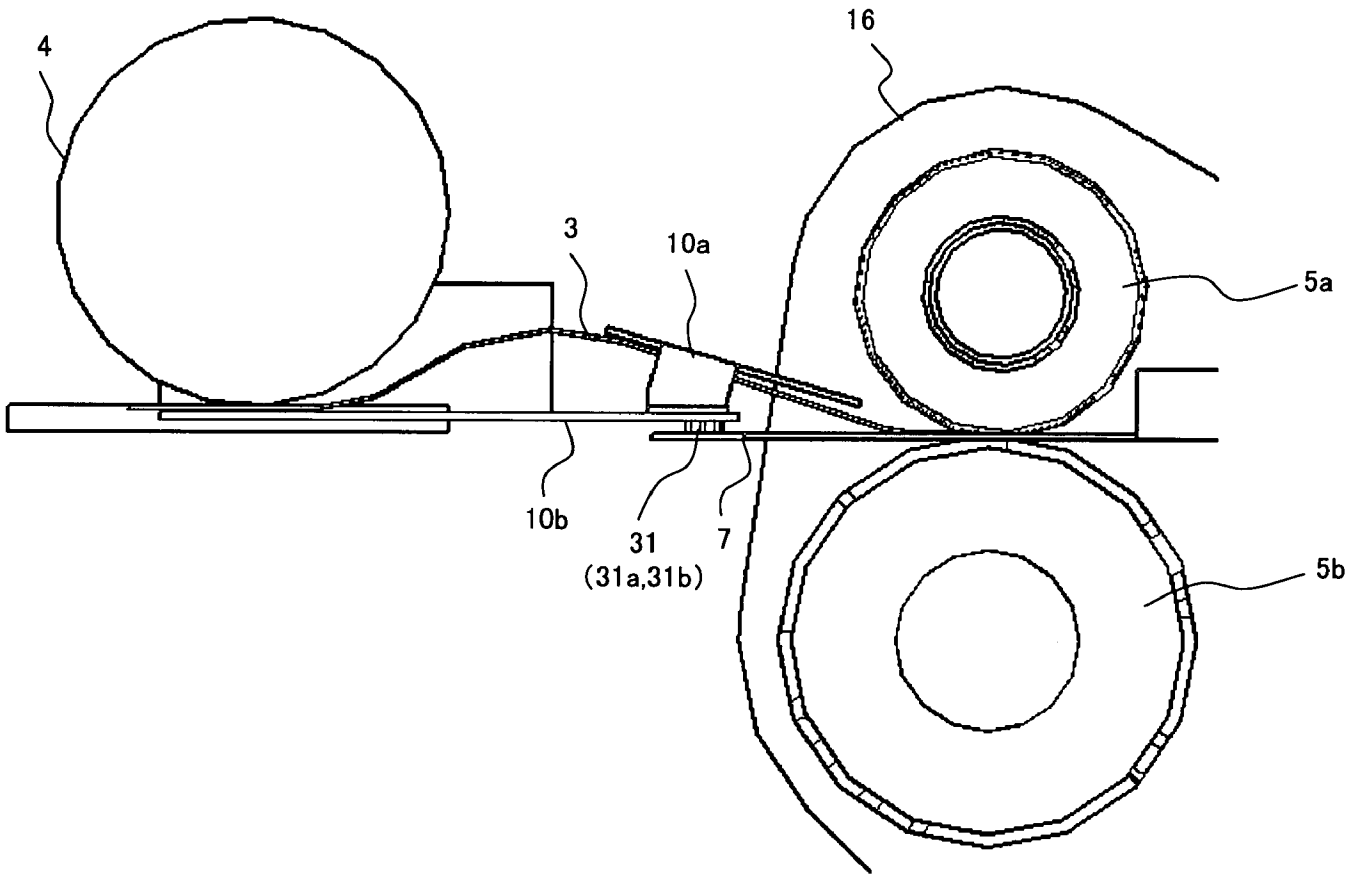
FIG. 18 shows the details of the relationship between the paper feed unit and the resist roller pair in a state when the belt platen moves upward.

Simultaneously, as shown in FIG. 18, when the belt platen 6 is located at the image forming position, the upper surface of the projections 31 (31*a*, 31*b*) provided on both sides of the feed guide 7 held to the belt platen 6 contacts the lower surface of the supply guide 10*b*. Thus, the supply guide pair 10 swung on the guide pins 20 (20*a*, 20*b*) (refer to FIG. 12) as rotation centers. Then, the supply guide pair 10 is loaded on the feed guide 7, and the urging device such as a spring etc. not shown in the attached drawings urges the supply guide pair 10 to the feed guide 7, thereby positioning the feed guide 7 in the height direction.

Figure 17:
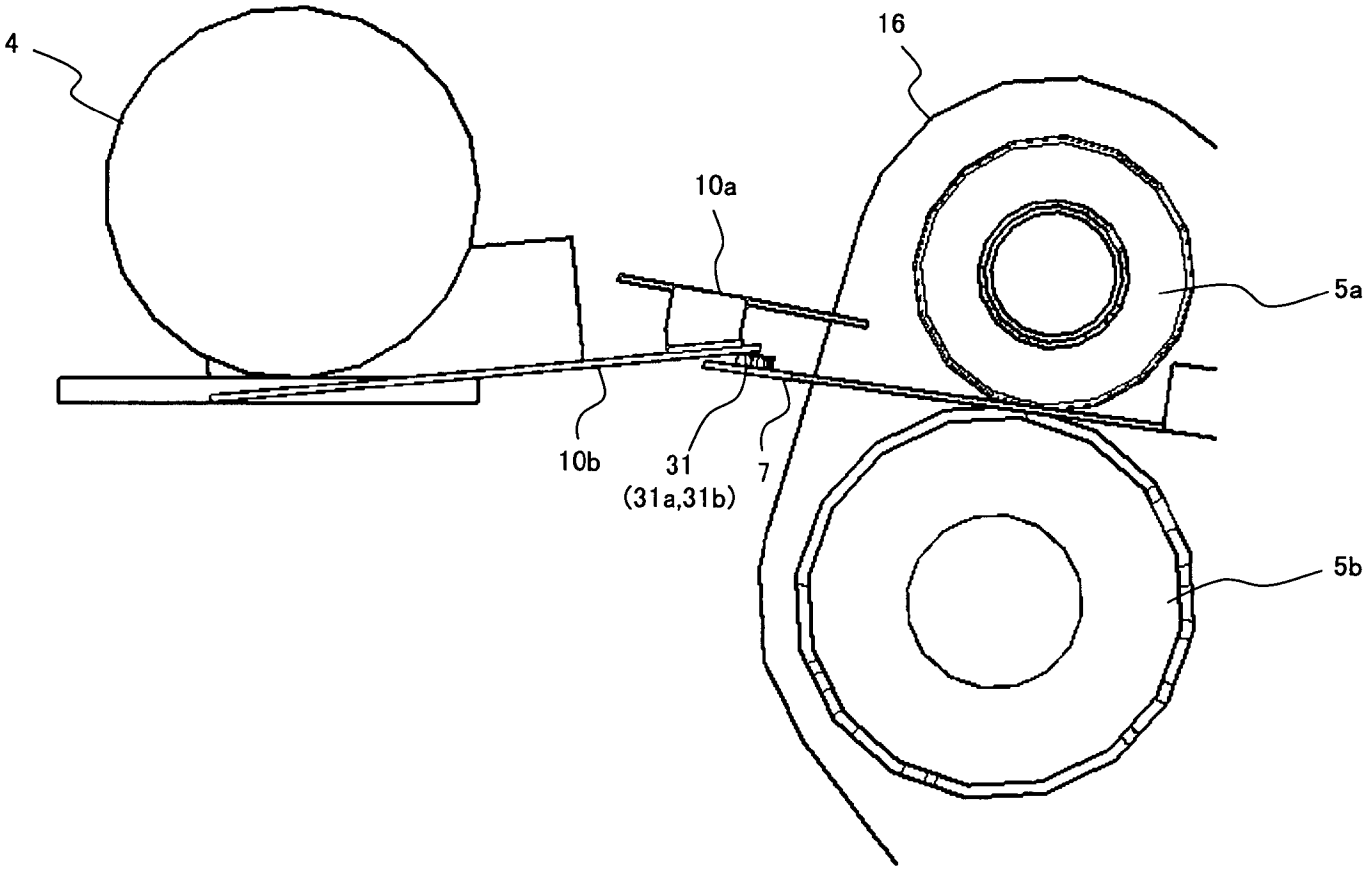
FIG. 17 shows the details of the relationship between the paper feed unit and the resist roller pair in a state when the belt platen moves downward.

As shown in FIG. 17, when the belt platen 6 is swung and moves downward, the supply guide pair 10 moves away on the guide pins 20 (20*a*, 20*b*) as rotation centers.

Thus, by positioning the supply guide pair 10 with respect to the feed guide 7, a feed path of stably feeding the paper 3 can be formed.

Figure 19:
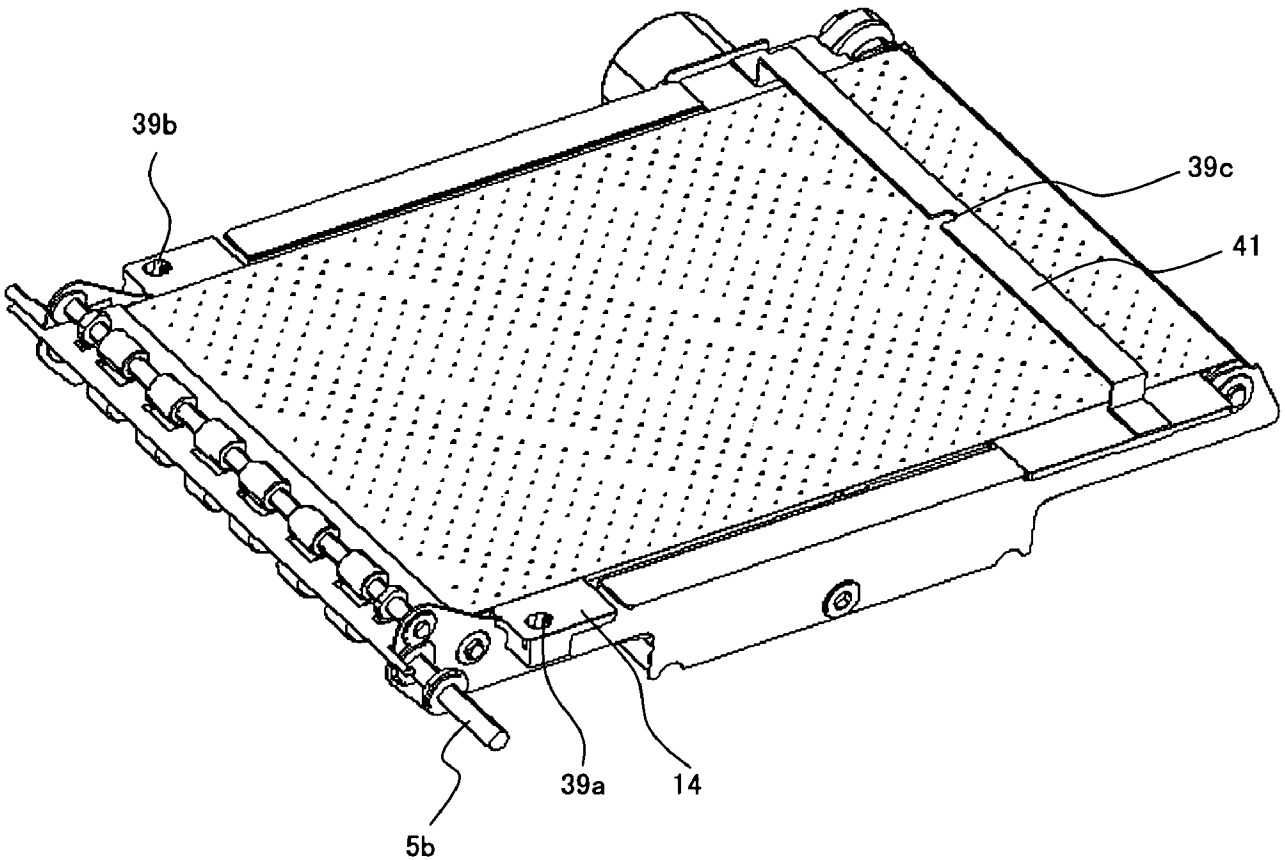
FIG. 19 is an oblique view of the belt platen shown in FIG. 18 and viewed from above.
Figure 20:
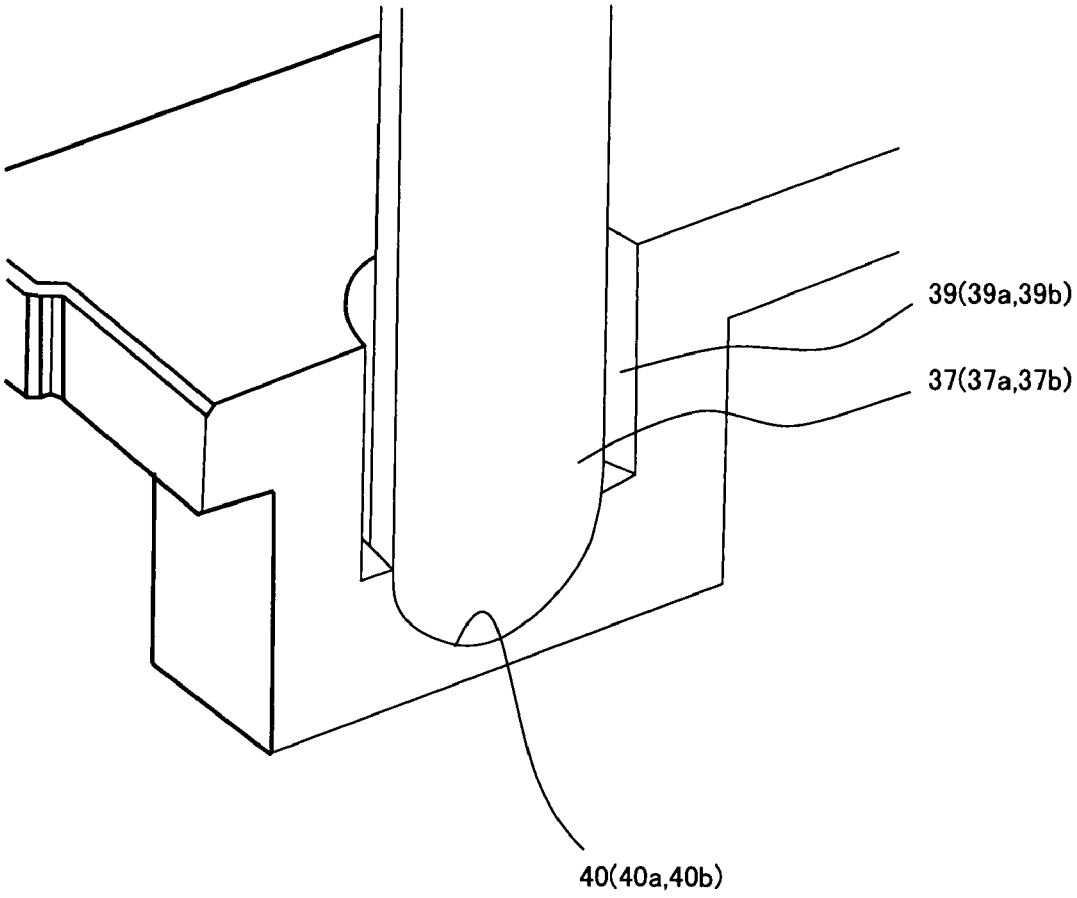
FIG. 20 shows the regulation member for positioning the head unit and the belt platen when the belt platen moves upward.
Figure 21:
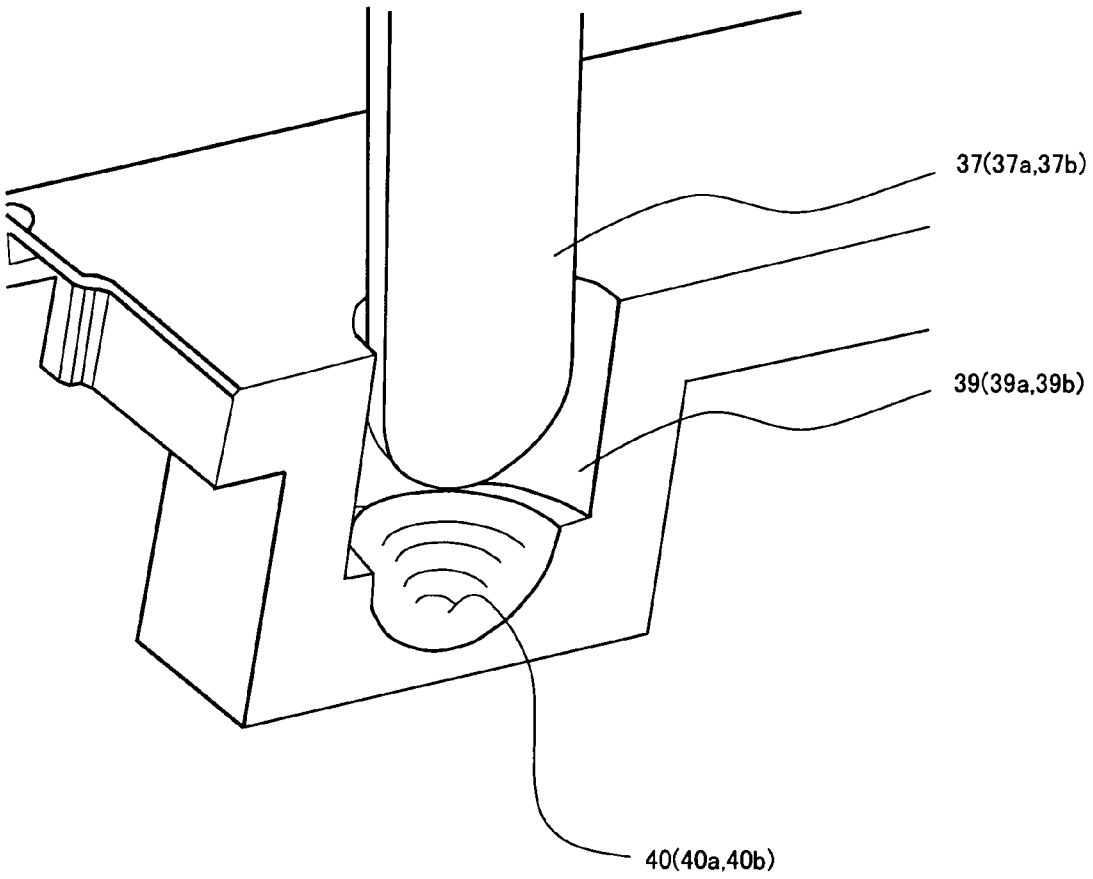
FIG. 21 shows the regulation member for positioning the head unit and the belt platen when the belt platen moves downward.

As shown in FIGS. 19 through 21, the platen 14 is provided with positioning grooves 39 (39*a*, 39*b*) as bearings for regulating the positions of the head frame 8 and the belt platen 6. The positioning grooves 39*a* and 39*b* are formed as oval holes having diameters larger than the outline of the positioning pins 37*a* and 37*b* in the direction orthogonal to the paper feed direction, and having idle space in the direction parallel to the paper feed direction. At the bottom, hemispherical grooves 40 (40*a*, 40*b*) are formed.

The positioning grooves 39*a* and 39*b* are provided on both sides of the feed path of the paper 3 at the upstream in the paper feed direction of the platen 14. The positioning groove 39*c* is formed as a notch having idle space in the direction parallel to the paper feed direction substantially at the center of a tie bar 41 provided over the feed path of the paper 3 at the downstream in the paper feed direction of the platen 14.

As shown in FIGS. 11 and 12, the head frame 8 holds ink heads 24*k*, 24C, 24*m* and 24*y* for jetting liquid ink of plural colors, that is, four colors of black, cyan, magenta, and yellow in the mode for embodying the present invention. The ink heads 24*k*, 24C, 24*m* and 24*y* are configured by one long head or a plurality of short heads such that each of them can have at least the same width as the paper 3.

The ink heads 24*k*, 24C, 24*m* and 24*y* are fixed and held at predetermined intervals in the feeding direction of the paper 3 in the direction orthogonal to the feeding direction of the paper 3. The head frame 8 is provided in the upstream opposite the belt platen 6, not fixed to the apparatus body frame 22, but is held so that it can be moved.

Figure 22:
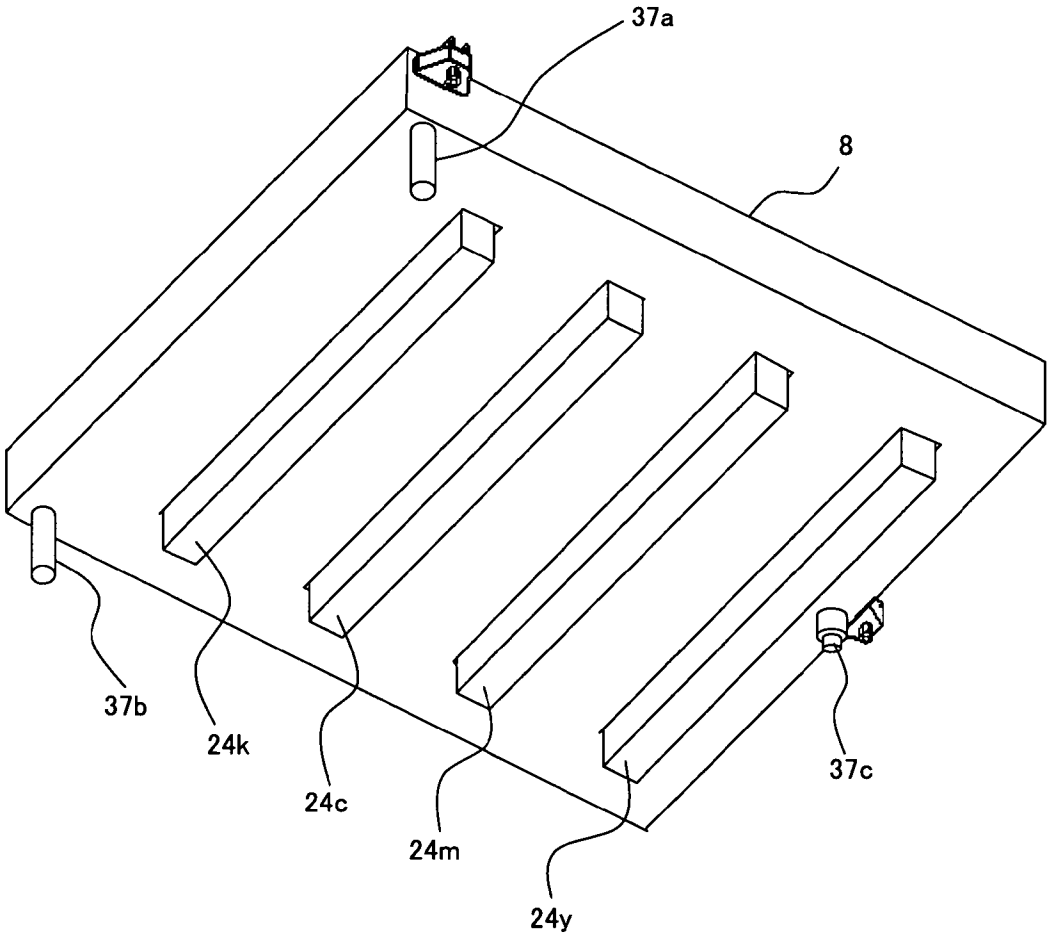
FIG. 22 is an oblique view of the head unit shown in FIG. 21 and viewed from below.

As shown in FIG. 22, the positioning pins 37*a* and 37*b* are fixed downward as axis units at the upstream in the paper feed direction below the head frame 8, and the positioning pin 37*c* is fixed downward similarly substantially at the center at the downstream in the paper feed direction.

The positioning pins 37*a*, 37*b*, and 37*c* are provided opposite the positioning grooves 39 (39*a*, 39*b*, 39*c*) formed in the platen 14. The tip portions of the positioning pins 37*a* and 37*b* are hemispheric, and the positioning pin 37*c* has a nail headed structures at the ends (refer to FIG. 22).

By the rotation drive of the up-and-down arms 19*a* and 19*b*, the up-and-down arms 19*a* and 19*b* are moved to the vertical position. Thus, when the belt platen 6 is lifted after swinging using the axis of the resist roller 5*b* as a rotation center, the positioning pins 37*a* and 37*b* are inserted into the positioning grooves 39*a* and 39*b*, and the positioning pin 37*c* is engaged in the a positioning groove 39*c*. Then, when the image forming position is reached, the hemispherical tip portions of the positioning pins 37*a* and 37*b* are engaged in the hemispherical grooves 40 at the bottom of the positioning grooves 39*a* and 39*b*, and the lower surface of the nail headed structures at the ends of the positioning pin 37*c* comes in contact with the upper surface of the tie bar 41, thereby positioning performed in the vertical direction (Z direction) and in the plane direction (X and Y directions).

That is, since the head frame 8 and the belt platen 6 are positioned using the positioning pins 37*a*, 37*b*, and 37*c* and the positioning grooves 39*a*, 39*b*, and 39*c*, the position accuracy of the resist roller pair 5, the driving roller 11, the driven roller 12, and the ink heads 24*k*, 24C, 24*m* and 24*y* fixed to the head frame can be finally guaranteed.

(Description of Operations)

Then, the operations of the image forming apparatus 1 with the above-mentioned configuration are described below.

First, a signal of an instruction to form an image is input from the operation panel not shown in the attached drawings by inputting an instruction to form an image or from the host equipment not shown in the attached drawings but connected through a signal line. Then, the control unit of the image forming apparatus 1 swings and moves upward the belt platen 6 by the up-and-down arms 19*a* and 19*b* synchronously driven for rotation in the α direction on the axis of the resist roller 5*b* as a rotation center.

As shown in FIG. 14 (and FIG. 20), when the up-and-down arms 19*a* and 19*b* are vertical, the positioning pins 37*a* and 37*b* fixed at the lower surface of the head frame 8 are inserted into the positioning grooves 39*a* and 39*b* formed in the platen 14 with idle space. Simultaneously, the positioning pin 37*c* is engaged in the positioning grooves 39*c* of the tie bar 41 provided in the belt platen 6. Furthermore, when the up-and-down arms 19*a* and 19*b* are vertical, the hemispherical tip surfaces of the positioning pins 37*a* and 37*b* are engaged in the hemispherical grooves 40*a* and 40*b* at the bottom of the positioning grooves 39*a* and 39*b* formed in the platen 14. Simultaneously, the plane portion at the nail headed structures at the ends of the positioning pin 37*c* contacts the upper surface of the tie bar 41, thereby loading and holding the head frame 8 on the belt platen 6. Thus, the head frame 8 and the belt platen 6 can be positioned in the plane direction, and the distance between the head frame 8 and belt platen 6 can be set to a predetermined appropriate print distance.

On the other hand, the feeding direction of the paper 3 by the resist roller pair 5 and the feeding direction of the paper 3 by the belt platen 6 is maintained by the attaching accuracy of the resist roller pair 5, the driving roller 11, and the driven roller 12 to the platen frame 16.

That is, by the positioning the head frame 8 and the belt platen 6, the position accuracy among the resist roller pair 5, the driving roller 11, the driven roller 12, and the ink heads 24*k*, 24C, 24*m* and 24*y* fixed to the head frame 8 can be finally guaranteed.

Then, after driving the resist roller pair 5, the driving roller 11, and the eject roller pair 34, the pickup roller 4 is driven.

Thus, the pickup roller 4 retrieves the top sheet of paper 3 on the paper feed tray 2, and the paper 3 is transmitted between the supply guide 10*a* and the supply guide 10*b* at the upstream in the paper feed direction of the resist roller pair 5.

The paper 3 passes between the upper supply guide 10*a* and the lower supply guide 10*b*, and then led to the feed guide 7. Then, the paper 3 reaches the nip position formed in the opposite portion between the resist roller 5*a* and resist roller 5*b*.

At this time, the pickup roller 4 is driven for rotation, but rotation of the resist roller pair 5 is temporarily stopped by the resist clutch 27. Thus, as shown in FIG. 18, the paper 3 fed toward the resist roller pair 5 contacts the nip position, and temporarily stopped. Therefore, a bending is formed. Then, straightness of the paper 3 corrects the feeding posture at the nip position of the resist roller pair 5. That is, if there is deviation in a feed path, the deviation is corrected.

Then, after a predetermined time, the stop of the rotation by the resist clutch 27 is released, and the resist roller 5*b* starts rotating. By the resist roller 5*a* rotating after the rotation of the resist roller 5*b*, the paper 3 passes the feed guide 7 at the downstream in the paper feed direction of the resist roller pair 5, and is fed to the belt 9 of the belt platen 6 at a predetermined speed.

The paper 3 is fed by the belt 9 of the belt platen 6. When the paper 3 is fed below each of the ink heads 24*k*, 24C, 24*m* and 24*y* loaded and arranged at the head frame 8, ink drops are discharged from the ink heads 24*k*, 24C, 24*m* and 24*y*, and an image is formed on the paper 3.

The paper 3 on which an image has been formed is led between the upper eject guide 36*a* and the lower eject guide 36*b*, ejected outside the apparatus by the eject roller pair 34, and stacked and stored on the eject tray 35.

According to the mode for embodying the present invention, the belt platen 6 has both axes of the resist roller 5*b* held by and rotates on the apparatus body frame 22. The other end is loaded on the up-and-down arms 19*a* and 19*b*. Therefore, since it is not completely fixed to the apparatus body frame 22, there is a small possibility that an undesired influence such as a large distortion etc. occurs in the belt platen 6 although a distortion occurs in the apparatus body frame 22.

Since the driving roller 11, the driven roller 12, the tension roller 13 for drive of the belt platen 6 of the belt platen 6 and the resist roller pair 5 are held by the platen frame 16 of the belt platen 6, the positions among them are not shifted. Thus, the paper 3 can be stably fed.

Furthermore, relating to the position accuracy between the ink heads 24*k*, 24C, 24*m* and 24*y* and the belt platen 6, the head frame 8 is only loaded and held on the apparatus body frame 22, but not fixed to the frame. Therefore, after the engagement of the positioning pins 37*a*, 37*b*, and 37*c* fixed to the head frame 8 in the positioning grooves 39*a* and 39*b* formed in the platen 14, and the positioning groove 39*c* formed in the tie bar 41, the head frame 8 moves.

Thus, by loading and holding the head frame 8 on the belt platen 6 through the positioning pins 37*a*, 37*b*, and 37*c*, the head frame 8 and the belt platen 6 are directly positioned and the position accuracy is guaranteed.

According to the mode for embodying the present invention, the driving roller 11 for drive of the belt 9, the driven roller 12, the tension roller 13, and resist roller pair 5 are held to the platen frame 16, and the belt platen 6 and the head frame 8 are positioned by the above-mentioned structure. Thus, the position accuracy among the ink heads 24*k*, 24C, 24*m* and 24*y* held and fixed to the head frame 8, the resist roller pair 5, the driving roller 11 for drive of the belt 9, the driven roller 12, and the tension roller 13 can be finally guaranteed.

Since the resist roller 5*b* is swung as a support point of the belt platen 6, the driving force for moving the belt platen 6 can be reduced. Furthermore, owing to the movement support point, the position reproducibility with other mechanisms fixed to the apparatus body frame 22 can be improved.

Therefore, although there occurs a distortion in the apparatus body frame 22 by the transportation condition etc., the position accuracy among the head frame 8, the belt platen 6, the ink heads 24*k*, 24C, 24*m* and 24*y* can be maintained, and a high quality image forming apparatus can be realized.

In the mode for embodying the present invention, the resist motor 26 is provided separate from the belt motor 42 for carrying a belt. Therefore, the resist roller pair 5 and the belt motor 42 can be separately controlled. Furthermore, the control of the feed speed can be variable depending on the type of the paper 3, and the drive source of the resist roller pair 5 can be supplied from the belt motor 42 as in the first mode for embodying the present invention.

What is claimed is:

1. An image forming apparatus, comprising:

a recording unit including an ink head capable of jetting liquid ink to a recording medium and recording an image;

a feeding mechanism including at least:

a feed belt put on between a driving roller and a driven roller so as to be arranged opposite to the recording unit, for feeding the recording medium, and a support frame for rotatably supporting the driving roller and the driven roller; and a resist roller pair arranged at an upstream position in a feeding direction of the recording medium with respect to the driving roller and the driven roller, for correcting a feeding posture of the recording medium and feeding the corrected recording medium to the feed belt, wherein the resist roller pair is rotatably supported by one of (i) the support frame, and (ii) a member integrally provided to the support frame.

2. The apparatus according to claim 1, further comprising a feed guide for leading the recording medium over the feeding mechanism from an upstream position in the feeding direction with respect to the resist roller pair.

3. The apparatus according to claim 2, further comprising:

a paper feed unit for supplying the recording medium, and a supply guide for leading the recording medium supplied from the paper feed unit to the feed guide, wherein the supply guide contacts and is positioned by the feed guide.

4. The apparatus according to claim 1, wherein the recording unit is held by the feeding mechanism during formation of an image on the recording medium.

5. The apparatus according to claim 1, wherein the member that is integrally provided to the support frame comprises an extended frame extended from the support frame.

6. The apparatus according to claim 1, further comprising a displacement mechanism capable of moving the feeding mechanism between an image forming position in which an image is formed on the recording medium and an evacuation position evacuated from the image forming position.

7. The apparatus according to claim 6, wherein the feeding mechanism is supported and changed between a liquid ink jetting direction of the ink head and a direction substantially parallel to the liquid ink jetting direction by the displacement mechanism.

8. The apparatus according to claim 6, wherein the feeding mechanism is moved on a support axis of one of the resist rollers of the resist roller pair as a center by the displacement mechanism, and both ends of the support axis are held by an apparatus body frame.

9. The apparatus according to claim 1, wherein the recording unit is loaded, held, and moved on an apparatus body frame.

10. The apparatus according to claim 1, further comprising a regulation member for regulating a relative position relationship between the recording unit and the feeding mechanism.

11. The apparatus according to claim 10, wherein the regulation member comprises:

an axis unit formed on at least one of the recording unit and the feeding mechanism, and which substantially and perpendicularly extends in opposite directions; and a bearing unit formed on at least one of the recording unit and the feeding mechanism, and which contacts or is engaged in the axis unit.

12. The apparatus according to claim 1, wherein axis directions of the resist roller pair, the driving roller, and the driven roller are parallel with each other.

13. The apparatus according to claim 1, further comprising a displacement mechanism for vertically moving the feeding mechanism such that the feeding mechanism becomes opposite to the recording unit, wherein the feeding mechanism is held only by the displacement mechanism.

* * * * *